US006460936B1

(12) United States Patent
Abramov et al.

(10) Patent No.: US 6,460,936 B1
(45) Date of Patent: Oct. 8, 2002

(54) BOREHOLE MINING TOOL

(76) Inventors: Grigori Y. Abramov, 4871 S. Dudley St., Littleton, CO (US) 80123; Nikolai I. Babichev, Bogorodsky Val, Moscow (RU); Mikhail M. Novikov, 4863 S. Quintero Cir., Aurora, CO (US) 80015; Ratko Polic, Radnika 30, Belgrade (YU), 11000; Sergey D. Tkach, Beloziorskaya 3a, Moscow (RU), 127543; Marcus A. Wiley, 1602 E. Red Fox Pl., Littleton, CO (US) 80126-2618

( * ) Notice: Subject to any disclaimer, the term of this patent is extended or adjusted under 35 U.S.C. 154(b) by 0 days.

(21) Appl. No.: 09/336,556

(22) Filed: Jun. 19, 1999

(51) Int. Cl.[7] ..... E21C 45/08

(52) U.S. Cl. ..... 299/17; 299/5; 299/1.05; 175/67; 175/40

(58) Field of Search ..... 175/67, 424, 40; 166/222, 242.6; 299/17.5, 1.05; 285/123.15, 123.1

(56) References Cited

U.S. PATENT DOCUMENTS 3,065,807 A * 11/1962 Wells ..... 285/123.1
3,286,163 A * 11/1966 Holser et al. ..... 324/338
3,638,970 A * 2/1972 Sandquist et al. ..... 285/123.15
3,747,696 A 7/1973 Wenneborg et al.
4,059,166 A 11/1977 Bunnelle
4,077,481 A * 3/1978 Bunnelle ..... 175/232
4,095,655 A * 6/1978 Still ..... 175/19
4,140,346 A 2/1979 Barthel
4,149,739 A * 4/1979 Morris ..... 285/123.1
4,212,353 A 7/1980 Hall
4,296,970 A 10/1981 Hodges
4,336,564 A * 6/1982 Wisniewski et al. ..... 361/154
4,381,610 A * 5/1983 Kramer ..... 33/312
4,708,395 A * 11/1987 Petry et al. ..... 299/17
4,718,728 A 1/1988 Hodges
4,814,768 A * 3/1989 Chang ..... 342/22
4,915,452 A 4/1990 Dibble
4,934,466 A 6/1990 Paveliev et al.
5,181,578 A 1/1993 Lawler
5,197,783 A * 3/1993 Theimer et al. ..... 299/17
5,366,030 A 11/1994 Pool, II et al.

* cited by examiner

*Primary Examiner*—David Bagnell
*Assistant Examiner*—John Kreck

(57) ABSTRACT

A borehole mining tool comprising a drill string having an inner pipe column and an outer pipe column. Water is forced under high pressure down an annulus between the outer pipe and inner pipe. A hydromonitor is attached to the end of the drill string. A nozzle in the hydromonitor directs the pressurized water into a stope or work area, thereby loosening the material to be mined. The slurry is educted from the mined area by the action of a venturi attached downstream of the hydromonitor. Water flow through the venturi creates a vacuum which draws the pregnant slurry from the work area up through the inner pipe to the surface. A plurality of tools may be attached to the hydromonitor by a connection comprising a gasket having an interference fit. The gasket allows quick connection and removal of a plurality of tools from the hydromonitor. A radar is include to provide an image of the stope being worked.

24 Claims, 20 Drawing Sheets

$x = 1/2(D - d)$

A

B

B

A

BOREHOLE MINING TOOL

BACKGROUND OF THE INVENTION (a) Field of the Invention

This invention relates to a system for providing remote hydrojet borehole mining, and more specifically, but not by way of limitation, to a hydraulic borehole mining system with interchangeable components that allow the use of a single device for a plurality of tasks. Some of the tasks that the instant invention could be used for: extraction or the mining of a mineral resources; the creation of a subsurface cavity or void space; to stimulate liquid and/or gas production; clean lake bottoms; recover either liquid or solid environmental contaminates; or other related uses which require a remotely operated tool.

The Borehole Mining Tool (tool) is intended for mining of mineral resources, through boreholes. This tool may be applied from the Earth's surface, underground mines and ocean platforms. The tool also will find an application in geological exploration for bulk sampling, in building of subterranean storages, in-situ leaching, production stimulation for oil/gas and water, in custom foundations, underground collectors construction, environmental clean up of subterranean spills and more. The tool can be used to solve other environmental problems, such as cleaning of lake bottoms and removing ooze, cleaning of oil reservoirs, radioactive contamination (nuclear missile silos), and other applications requiring remote operating.

(b) Discussion of Known Art

Borehole mining (BHM) as a remote underground mining method is based on water jet cutting of rock material. This is accomplished by pumping high pressure water down to the working area from the Earth's surface (or underground mines, or floating platforms) to the borehole mining tools lowered into pre-drilled holes. The slurry created by the water jet is simultaneously pumped out by the same tool. By removing the broken materials, underground cavities (stopes) can be created.

The BHM approach has many recognized advantages, but the method has not gained acceptance commensurate with its potential due to several important issues that have yet to be finalized. One of the most significant problems has been the specialized tooling needed for mining of different type of material and specific geo-technical and environmental tasks to be performed, which requires that the user needs to carry and the use of different tools to the work site instead of a universal one. These tools are typically large and heavy units having a minimum number of joints, couplings, threads and other easy-and-quick connectors which complicates the tool's assembly, accessibility, serviceability and replacement. In case of a failure of some part of the tool, the replacement of this disabled unit(s) usually requires a replacement of most, if not all, of the tool.

Another problem is that borehole mining is a blind method; there is no data about the current cutting direction as well as the current configuration of the driving space (cavern/stopes). All geophysical measurements (logging) may be executed only after all operations are stopped and the BHM tool is removed from the hole. This typically equates to several hours of down time. Additionally, because borehole mining is carried out in friable, unconsolidated (unstable) material, the shape of the created stopes can be easily changed by collapsed rock masses. Thus, measurements, made after stopping of operation can not always be used for estimation of production. Best downhole measurements must be made while mining: or "logging-while-mining" (LWM). This instant tool will allow for the attachment of monitoring devices which will give "eyes" to borehole mining.

In certain circumstances it is necessary to build vertical slots using several boreholes and then connecting them to each other, for example to create an extended underground collecting ditch. In this task, information about orientation of the tool's nozzle down in a borehole becomes very critical. But, through assembling and lowering the tool in a hole, its bottom part (which contains the head and the hydromonitor's nozzle) is twisted relative to the upper portion of the tool. Thus, after the tool is assembled and lowered down in a hole, there is no further information about the current bottom head's nozzle orientation; as it is lost while assembling.

In borehole mining, a hole is first drilled from the surface to a depth where the mineral deposit or work area is located. A metal or plastic casing, which is nothing more than a heavy pipe, is then inserted into the hole to prevent sidewall caving or capsizing of the hole. The casing bottom end, called a casing shoe is placed immediately above the future working (production) interval. Then, the borehole mining tool is lowered into this casing until its bottom (working) end portion reaches the "open" hole, right bellow the casing shoe.

The BHM tool consists of three main parts: an upper head, an intermediate column and a bottom (working) head. The upper head includes stub-pipes for pumping in a working high-pressure fluid (usually water) and for discharge of production slurry; a swivel; a turn table; and a mechanism for raising/lowering the tool while mining. The intermediate column is comprised of two or more pipes assembled in "pipe-in-pipe" manner by numerous dual conduit sections. At the end of this column is the bottom head with its hydromonitor and eductor (also known as hydro-elevator, or jet-pump). In most cases, a drill bit can also be placed at the bottom end of the tool.

The inner and outer columns of the tool form an O-shape gap. Thus, the tool has at least two hydraulic channels: one is the inner pipe's channel (inner channel), and the other is the aforementioned ring gap, or outer channel. These channels are used for delivery of high pressure working fluid (water) to the bottom head and for elevating production slurry back to the surface. It is obvious that two channels are the minimum required in borehole mining. Therefore, in BHM two main schematics of water/slurry circulation are used: (1) the "direct"; water is pumped by inner pipe and slurry is received by the gap and (2) the "return"; opposite circulating. Because of its relative simplicity, over 90% of existing BHM tools are based on these two schematics. The schematic of fluids circulating is reflected on the configuration of the top head and other surface equipment.

The borehole mining tool functions as follows: The tool is lowered into a borehole until the hydromonitor (which is located in a bottom head) is placed below the casing shoe in an open hole to the depth that the actual mining is to take place. Next, the high pressure (working) water, approx 2000 psi at a flow rate of 1000 GPM, is pumped down to the tool through one of the two channels or annulus' contained in the intermediate pipe. In the bottom head one part of this water is split off to the hydromonitor which contains a nozzle directing the water to the area to be worked-out. As it passes through the nozzle, this flow accelerates to a water jet that is sufficiently powerful to break and scale away the material being mined. The loosened rock/ore material from the worked out area is fluidized through mixing with water to create a productive (pregnant) slurry.

The created slurry must be drawn to the surface to clean the working space (stope/cavern) and to recover the desired mineral(s) or create the desired cavity. For this purpose, the remaining portion of the working water continues flowing down until it reaches the eductor which forces it to turn which creates a vacuum in front of the Venturi pipe opening. This vacuum sucks the incoming slurry, drawing it into the slurry channel of the tool and then it is transported up the pipe until it reaches the surface.

On the surface, the water contained in the slurry is separated from heavy particles (rock/ore chunks and other solids)in a collecting pond or tank by gravity force (and/or other standard equipment, if needed). The clarified water is pumped down to the working interval again. This completes the BHM water re-circulating cycle. While operating, the tool is rotated and moved up and down in the hole within the production (working) interval. The borehole mining process usually creates underground caverns.

It can be appreciated that the effectiveness of the rock cutting and slurry recovery are of great importance in the overall performance of the whole BHM tool and operation. One method of causing the slurry to rise through the return (slurry) channel is by pressurizing the entire system, including the cavity where the mining operations are being carried out, thus forcing the slurry through the return pipe. Another method for drawing the slurry to the surface is to include an eductor near the lowest point on the tool in order to force draw the slurry into the return pipe.

The eductor type pump has been favored in borehole mining since the simplicity of the device results in high reliability. The need for high reliability is a critical element for borehole mining tools, since failure of a component at a great depth can result in long down times and expensive procedures for trying to retrieve the tool through the borehole. The Venturi effect that is used to draw the slurry into an orifice(s) (slurry intake port(s)) in the device is created at a region on the tool that lies below the cutting jet. This allows the tool to draw material from the lowest possible position in the cavity created by the tool. Often, however, the orifice used to draw material is not at the lowest point on the tool. Therefore, with these configurations additional portions of the tool are located at the lowest position within cavity being mined. This is a serious disadvantage since the solids of the slurry will tend to settle and fill this low area.

Examples of tools which include points that are below the slurry intake ports include U.S. Pat. No. 5,366,030 to Pool, U.S. Pat. No. 4,718,728, and 4,296,970 to Hodges, U.S. Pat. No. 4,212,353 to Hall, U.S. Pat. No. 4,140,346 to Barthel, U.S. Pat. No. 4,059,166 to Bunelle, and U.S. Pat. No. 3,747,696 to Winneborg et al. Known devices for borehole mining have suffered from limited applicability. For example, one known device taught in U.S. Pat. No. 5,181,578 to Lawler, is a borehole mining tool which uses a swing-away hydromonitor that collapses to allow extension or retraction of the nozzle. This extension and retraction of the nozzle allows the user to improve the reach of the nozzle within the cavity being mined.

Another device which addresses the problems associated with the reach of the cutting jet nozzle is taught in U.S. Pat. No. 4,915,452 to Dibble. The Dibble invention teaches the use of a cutting head nozzle which can be moved relative to the rest of the tool in order to manipulate the position of the cutting jet without affecting the position of the slurry or intake portion of the tool.

A known device for borehole mining is shown in U.S. Pat. No. 4,934,466 to Paveliev, which has the blast pipe going through the eductor nozzle. With the same rate of pumping water, it allows an increase in the suction of the eductor because the diameter of its nozzle and thus the diameter of the water jet is also increased. This tool is not free from disadvantages. The drill bit located below the eductor does not allow slurry to be recovered from the very lowest points of the working area. Thus, this tool can not be successfully used, for example in cleaning of oil (or any other) storage, vessel or tank. The other disadvantage of this invention is the usage of an external pipe as a slurry channel. It excludes the possibility of using an airlift because there is no simple method to place an air pipe in this gap due to its rotation. Further, the annulus channel has 2 to 3 times smaller cross section than the inner pipe. This limits the maximum possible size of slurry chunks to be transported through the external channel in comparison to the internal one. Finally, these "double" walls increase the slurry pressure loss nearly two-fold due to the doubled hydraulic friction. In other words, the usage of an inner column as a slurry line, as does the Paveliev tool, increases the maximum size of transported chunks, while decreasing slurry flow pressure loss. The above mentioned disadvantages narrow the area of this tool application.

U.S. Pat. No. 5,366,030 to Pool has a design similar to Paveliev construction and is suffering from the same problems. Additionally, both devices have only two hydraulic channels. In certain circumstances, a tool with three or even four individual channels is required. Also, structurally these two devices are based on using a casing column as an outer pipe of the tool. However, oftentimes, structural and hydro geological conditions of the deposit allow operation in a borehole without the requirement to stabilize the walls through the uses of a casing string. In this situation, a double wall tool is preferable as it saves operational time and capital cost, because the outer pipe is "traveling" together with the tool from hole to hole instead of remaining in each worked-out well.

Another known device for borehole mining is U.S. Pat. No. 4,059,166 to Bunnelle. This device is also based on the "pipe-in-pipe" double column construction. These two columns define two hydraulic channels: the inner—slurry channel, and a gap between inner and outer columns which is used as high pressure water channel. At the bottom of the tool, there is a working head with a hydromonitor and an eductor sections. This device works as follows: The high pressure water is pumped down through the gap between inner and outer columns. At the hydromonitor section, part of the flow is diverted to the hydromonitor and becomes a water jet directed toward the rock which it cuts. Broken parts of rock material are mixed with spent cutting water to create a pregnant (productive) slurry. Another portion of the working water continues its movement down and finally reaches the eductor which produces the vacuum. This vacuum sucks the coming-up slurry. The slurry enters the inner pipe, through with it reaches the surface. The hydromonitor which has a cylindrical barrel and a standard conical nozzle at its end crosses the inner (slurry) pipe, splits (bifurcates) the flow at that point, forming a slurry fork-pass around the hydromonitor. The eductor section of the Bunnelle tool has a needle in its nozzle. This needle controls the suction of slurry in the same manner as the tools mentioned above. It also has a distribution reservoir located below the eductor. A drill bit can be attached to the reservoir which is located at the lowest point of the tool. In addition to an Earth's surface application, this tool can be mounted on a sea/ocean platform or barge and used to develop an offshore mineral zone or create voids for foundation or other requirements.

The Bunnelle device has the most relative (closest) design to the instant invention.

Main disadvantages of the Bunnelle tool are following:

1. Limited area of application. The tool can not remove the slurry at the lowest point of the working area because below the suction area is located the distribution reservoir and the drill bit.

2. A high number of moving mechanisms, parts, springs, pistons and cylinders decrease the reliability of the device, while increasing hydraulic friction and water pressure loss.

3. The inlet to the hydromonitor is located very close to the outer pipe wall. Part of the high pressure water flow makes a sharp turn to come into the hydromonitor at this point. The very high velocity of the water flow (5–10 m/sec), along with the sharp turn and the narrow space where this turn occurs, creates a high grade turbulence in water flow right before the hydromonitor nozzle. As a result, it negatively reflects on the hydrodynamic characteristics of the water jet: it becomes an unfocused, spray-type flow. Obviously, it therefore, decreases the water-jet productivity and also decreases the tool's overall borehole mining effectiveness.

The main disadvantage of all the afore mentioned devices is their limited area of application. Each of these tools was developed for a specific borehole mining task of which it can successfully execute. At the same time, choosing of the type of the borehole mining tool is based on a combination of different types of various criteria such as a deposit's hydrogeological situation, hardness, specific gravity, granule distribution of the mining material(s), depth of operations, rock mechanic characteristics of cap and bed rocks and several additional criteria. This combination dictates the type and configuration of borehole mining tooling, equipment and methods of BHM operation. Thus, for example, a tool which can effectively develop a sand-type material may not be very successful at the mining a clay-type material. Another example: a device for borehole mining can not be effectively applied for the purpose of cleaning a metal reservoir, and for creating underground pillars. Thus, there still remains the need for a universal borehole mining tool which can be easily modified to suit varied operations and technical tasks.

Borehole mining practice requires that, in some circumstances, it is necessary to have a four channel BHM tool. In addition to (1) water and (2) slurry channels, there is often a need for a channel for (3) air lift and another (4) extra channel for injection of a secondary agent to the working area to improve the effectiveness of the mining or cleaning process. Thus, it is important to have a 4 channel tool.

Another important aspect of the borehole mining tool, is its weight. Borehole mining is typically conducted at depths in excess of 50 m (150 feet) to 200 m (600 feet), and even deeper to 1 Km (3,300 Ft). Since the tool must be rotated at such a great depth while being suspended in a hole, it must be able to support not only its own weight, but also weight of water and slurry columns in both channels and transmit the torque through the tool's body. As it was shown before, in general, BHM tools have doubled body ("pipe-in-pipe") construction, which doubles the weight of the tool and limits the working depth because of the risk of the tool rupture and loss. It also increases the tool initial and operational cost. Thus, it is important to reduce the weight of the tool.

There remains a need for a borehole mining tool which reduces pressure losses while pumping the working water through the bottom head and returning slurry to the surface. Importantly, there remains a need for a borehole mining tool that allows the user to know the orientation of the water jet being delivered to the working area. Still further, there remains a need for a borehole mining tool that allows the user obtain an image of the shape of the excavated area while mining, and thus increase the effectiveness of the jet cutting, raise safety and, finally, improve borehole mining as a process.

SUMMARY

It has been discovered that the problems left unsolved by known art can be solved by providing a borehole mining tool with a bottom head with a universal connector that can accept various mechanical components and parts to easily modify the function of the whole device. Thus, a configuration of the tool for a specific task can be carried out by simple modification of the bottom portion, or by replacing of some components by the same-type components with a different technical or hydro-dynamical characteristics as explained below.

Another aspect of the instant invention, is that an improved hydromonitor section for use with the tool has been developed. The hydromonitor includes a conical barrel and a nozzle that is positioned slightly offset from the center area of the hydromonitor section. The offset positioning of the entry of the hydromonitor provides for a more smooth turning of the pressure water flow as it enters the hydromonitor. This decreases the turbulence in the working fluid flow and improves the availability of fluid to the nozzle, thereby, enhancing the water jet characteristics. This makes the jet more focused and thus more powerful. Finally, it increases the tool's working radius and productivity of the rock cutting and overall borehole mining effectiveness.

The orientation of the hydromonitor nozzle as well as the overall shape of the driving cavity being created in the strata as it is being developed can be obtained by including a radar device near the nozzle of the hydromonitor, along with a current generator to produce small currents and a device to measure current changes as the tool is moved through the Earth's natural magnetic field. The signals collected from the radar and the current generator can be used to derive the orientation of the nozzle relative to the Earth's magnetic field (survey) and an image of the cavity formed while mining. Developing this data allows for the creation of a current 3D image of the driving space (cavern) and also for the instant calculation of its volume and the current productivity of the Borehole Mining operation itself.

While the above and other advantages and results of the present invention will become apparent to those skilled in the art from a study of the following detailed description and accompanying drawings, which explain the contemplated novel construction, combinations and elements as herein described, and more particularly defined by the appended claims, it should be understood that changes in the precise embodiments of the herein disclosed invention are meant to be included within the scope of the claims, except insofar as they may be precluded by the prior art.

The main idea and the purpose of this instant invention is the development of a multi functional (universal/versatile) borehole mining tool. By the shifting of various parts, details and units this device changes its functional features which expands the area of its application, enabling it to work in different hydro-geological conditions and physical properties in the extraction of material(s). Additionally, this tool should present higher reliability, less water/slurry pressure loss, lower device total weight and a reduction in the cost of its manufacture and operation. This tool also should be able to solve different type of mining, environmental, building and other problems. In other words, this tool should be universal, with the ability to execute different types of jobs depending on the engineering task requirements by simple shifting of its working parts, details, and units.

To achieve this purpose this tool should have:

wider area of application, increased reliability, improved hydrodynamic characteristics of water and slurry channels, possibility of control of the driving space (cavern), four individual hydraulic channels, possibility of decreasing the weight of the device, lower initial and operational cost.

BRIEF DESCRIPTION OF THE DRAWINGS

FIG. 7BB is the eductor cross section as indicated on FIG. 7B.

FIG. 9A is the upper portion of the eductor;

FIG. 9B is the eductor's insertion throat;

FIG. 9C presents the bottom part of the eductor with the eductor nozzle;

FIG. 9D illustrates the bottom part of the eductor with the universal connector ready-to-accept additional equipment;

FIG. 9E is the bottom end ring-type eductor;

FIG. 9F the same as E but with the telescopic slurry sucker;

FIG. 9G presents the auxiliary nozzle;

FIG. 9H the bottom part of the tool with the draw needle, extra slurry inlets, electronic compartment and the drill bit;

FIG. 9I illustrates assembling of the solid needle;

FIGS. 9J and K illustrate two possible endings of the tool: with the drill bit and the blind end respectively;

FIG. 9L illustrates possibility of attachment of the drill bit to the tool bottom having the ring-type eductor;

FIG. 9M illustrates possibility of attachment of the electronic compartment to the ring-type eductor;

FIG. 10A—preferred light embodiment with straight hub and the conventional (central type) eductor;

FIG. 10B—preferred light embodiment with the third channel duct (airlift);

FIG. 10C—the same as 10B, but without the hydromonitor section, air lift, and the drill bit;

FIG. 10D—illustrates the ring-type eductor and the secondary agent duct going through the bottom head, ending below the tool's lowest point;

FIG. 10E—the same as A, but with the reverse hub and reversal surface equipment connections;

FIG. 10F—the same as A, but with the logging positioning system;

FIG. 10G—illustrates two hydromonitor sections joined together serially.

FIG. 11A straight hub;

FIG. 11B reversal hub;

FIG. 11C the same as 11A, but with the secondary working agent duct connected to the space between the tool and the casing, D, E and F are cross sectional views as indicated;

Note: The tool 10 has several details and parts, going through the whole device from the top to the bottom, (for example, outer 68 and inner 70 pipe columns). In order to decrease this parts numbering, they have the same number, but following indexes are added, to determine the location: "B"—Bottom head, "I"—Intermediate section, H—hydromonitor section and E—Eductor section.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF PREFERRED EMBODIMENT

While the invention will be described and disclosed here in conjunction with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
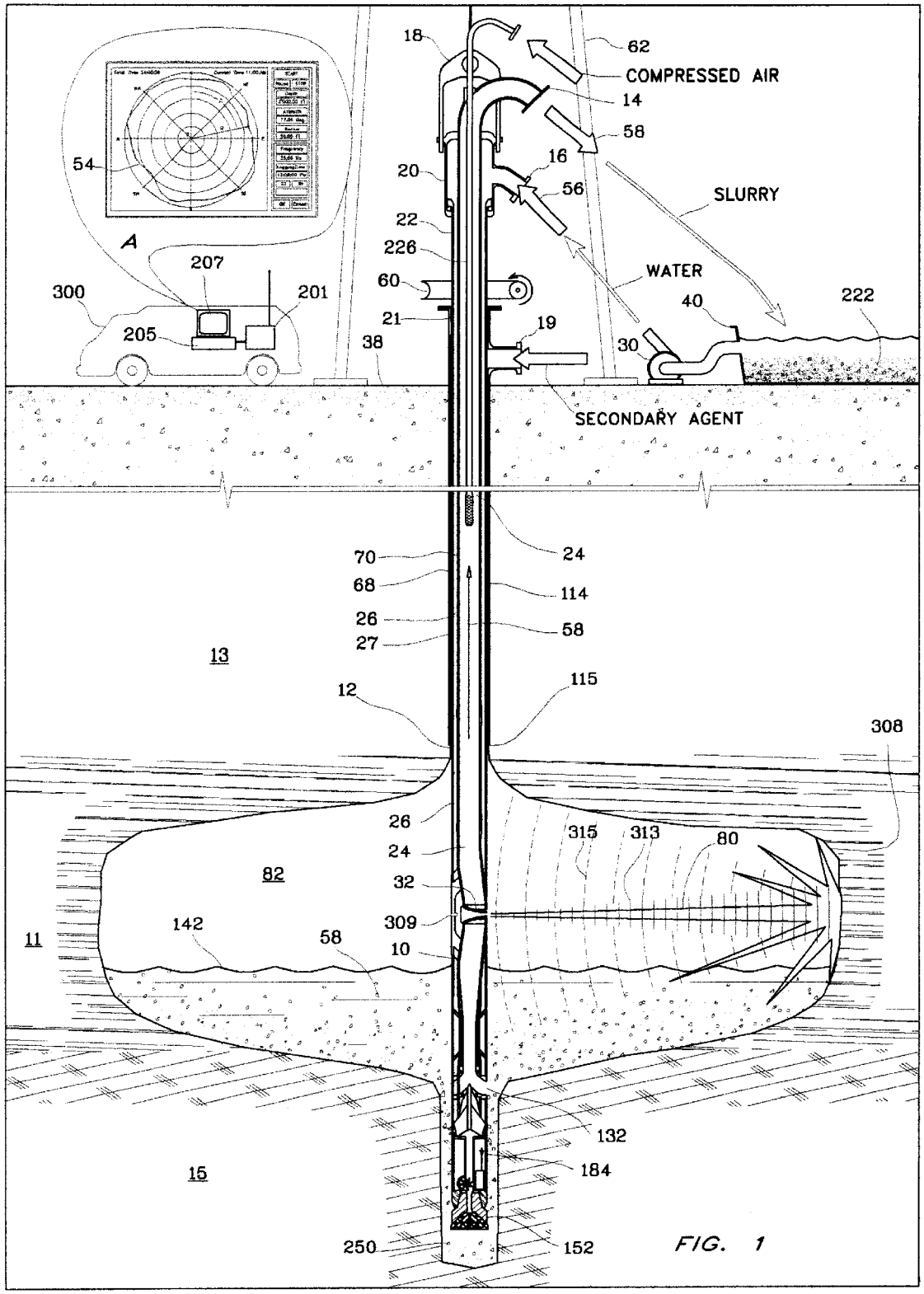
FIG. 1 is a side view of one preferred embodiment of the invention illustrating four channel double wall tool embodiment with attached radar positioning system. Inset A is an enlarged and detailed computer screen view.

FIG. 1 illustrates the preferred tool 10 embodiment including four individual channels and positioning radar system. As it seen, the borehole 12 is drilled from surface 38 to the production interval 11. The casing 114 is installed from the surface 38 through the caprock 13. The open hole is drilled bellow the casing shoe 115 with the sump area 250 at its lowest level.

The borehole mining tool 10 is lowered and suspended in a borehole 12 by drill rig tower 62. The tool 10 includes 4 hydraulic channels: (1) inner duct 226, (2) the gap 24 between the duct 226 and the inner drill pipe column 70, (3) the gap 26 between pipe 70 and outer pipe column 68, and finally, (4) the gap 27 between the pipe 68 and the casing 114. These four 16 channels are respectively connected to: air compressor (not shown), collecting tank/pond 40, water pump station 30, and secondary agent source (not shown).

Tool 10 embodiment also includes the radar positioning system comprising of an electronic compartment 184, radar gun 309 mounted inside of the hydromonitor 32 and the surface computer center 300.

Figure 2:
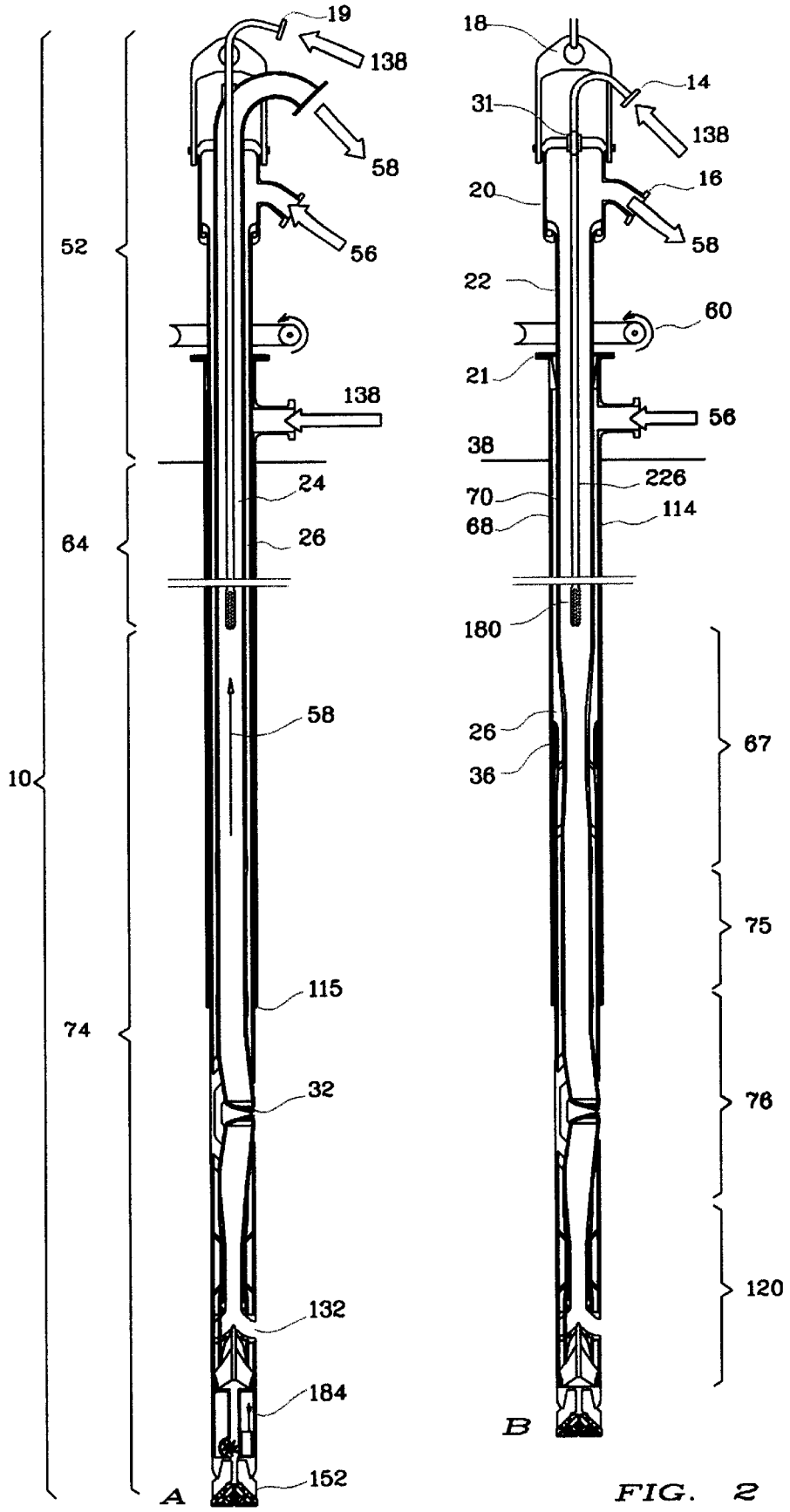
FIG. 2 is a side view of the invention taught herein describing its main units, parts, blocks, and details for (A) double wall four channel (heavy) and (B) single wall three channel (light)tool embodiment.

Turning now to FIG. 2 where both: "heavy" (A) and "light" (B) modifications of the tool 10 shown with the main sections and parts more detailed. The tool 10 has a top head 52, an intermediate section 64 and a bottom head 74. In turn, the bottom head 74 includes a hub section 67, extended section 75, hydromonitor section 76 and an eductor section 120.

Figure 3:
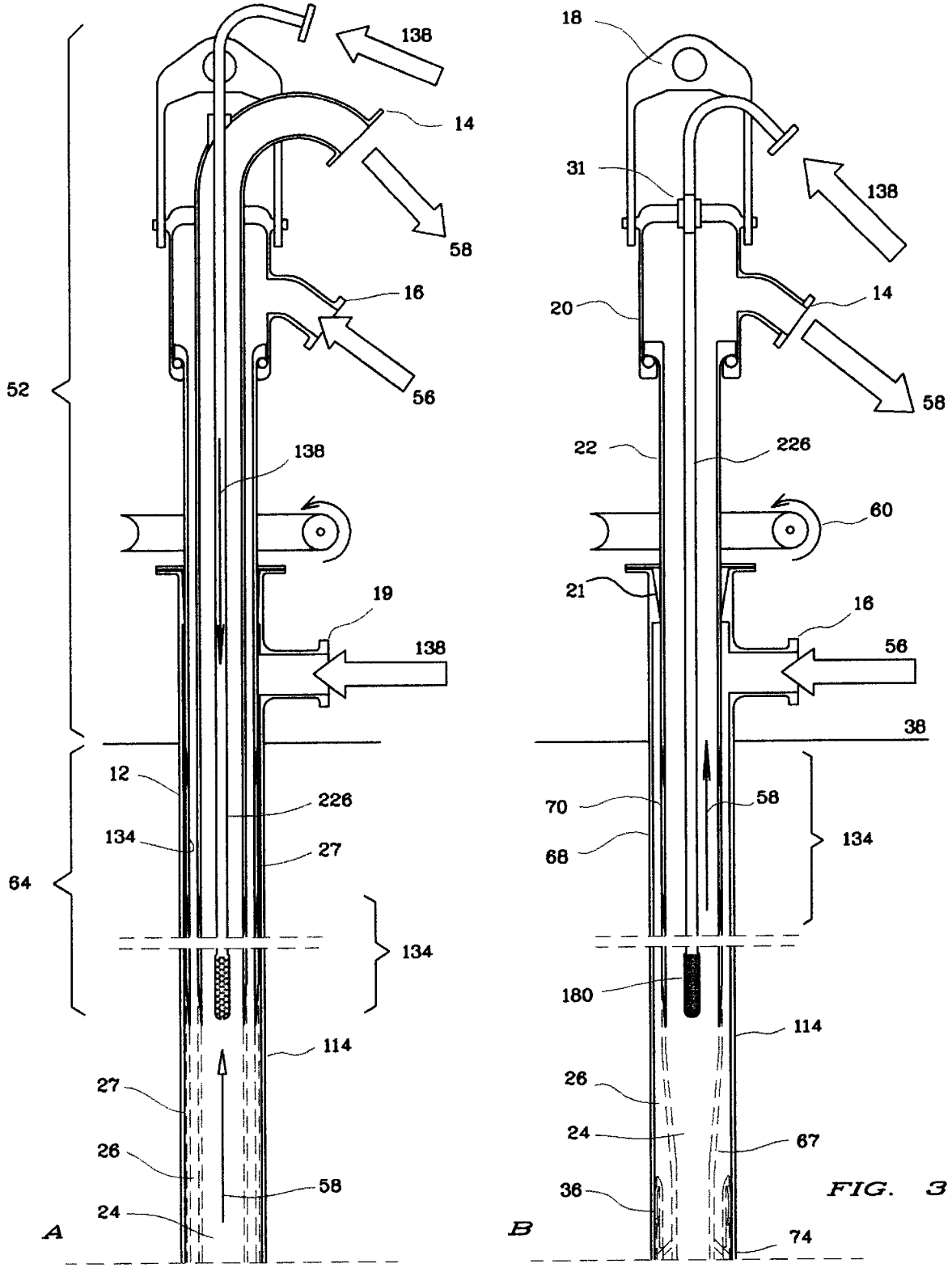
FIG. 3 is a side view of the top head and the multi-sectional intermediate column of: A—four channel and B—three channel tool.

FIG.3 illustrates the upper part of the tool 10. Attached to the top head 52 are stub pipes 14 and 16 that are used for providing or withdrawing a high pressure working fluid 56 (mostly water) or productive (pregnant) slurry 58, produced by the mining operations. The top head 52 also includes a swivel 20, a Kelly pipe 22, and a gland 21. Gland 21 seals the upper end of outer column 68, allowing it to slide up and down and rotate the Kelly pipe 22. Swivel 20 has a gland 31 allowing suspension of a secondary agent duct 226 inside of the tool 10. Finally, the upper head 52 may have an extra stub pipe 19 for a secondary agent. Tool 10 suspension includes also an elevating system 18 for lifting and lowering the tool 10 and a turntable 60 that is used to rotate the tool 10 while operating.

The construction of the tool 10 is based on traditional "pipe-in-pipe" schematic: it consists of at least two pipe columns: inner (internal) 70, and outer (external) 68. Thus, the tool 10 has at least two hydraulic channels: an inner 24 which is simply the internal 70 pipe inside space and a gap (annulus) 26, formed by internal 70 and external 68 columns. These two channels (24 and 26) are used for pumping down the working water 56 and receiving-back (rising) the slurry 58. The intermediate section 64 consists of numerous separate sections 134 which are used to extend the tool 10 to achieve a desired production interval 11.

The borehole 12 may be fixed by a casing 114 column which is used to protect this hole 12 from collapsing. It gives an extra gap channel 27 defined by the casing 114 and the tool 10. This channel 27 has access through the extra stub pipe 19 and can be used for injecting a secondary agent along the tool 10 to the working area 82 shown on FIG. 1.

The cased borehole 12 allows the weight of the total tool 10 to be cut nearly in half as compared to the prior art devices. In this case, the construction of the top head 52 and the intermediate section 64 is based on using the casing 114 as the tool's 10 external (70) pipe. Thus, the bottom head 74 is suspended in the hole 12 from the inner pipe 70 only.

In addition to the inner pipe 70, the tool 10 may contain at least one additional duct 226 which is used to carry a secondary working agent 138 such as an air, or any chemical reagent. Nitrogen, other gas, concrete, clay mud, foam and other material may be used to enhance the working 82 area environment and increase the tool 10 productivity.

Figure 4:
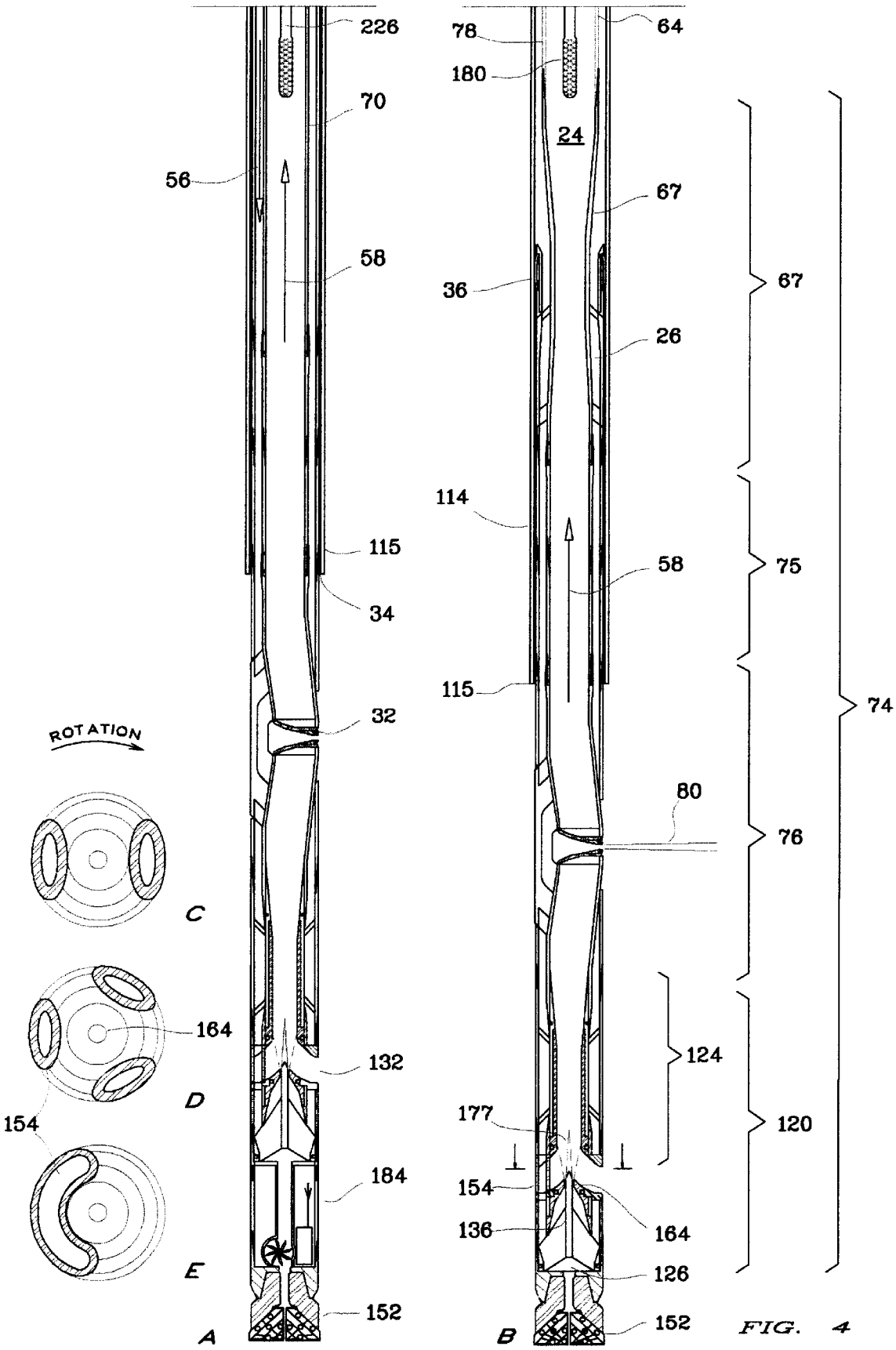
FIG. 4 is a side sectional view of the bottom head; A four channel (double wall) tool, B—three channel, (single wall tool), and C, D and E—cross sections illustrating different embodiment of the eductor's suction area (images increased twice).

As shown on FIG. 4, a bottom head 74 is attached to the lower end 78 of the intermediate section 64 by means of a hub 67. The bottom head 74 includes the hydromonitor section 76 with a hydromonitor 32 which is used to create and deliver a high velocity stream (water jet) 80 of working fluid 56 to the material 308 located in production interval 11 being mined (FIG. 1).

Figure 5:
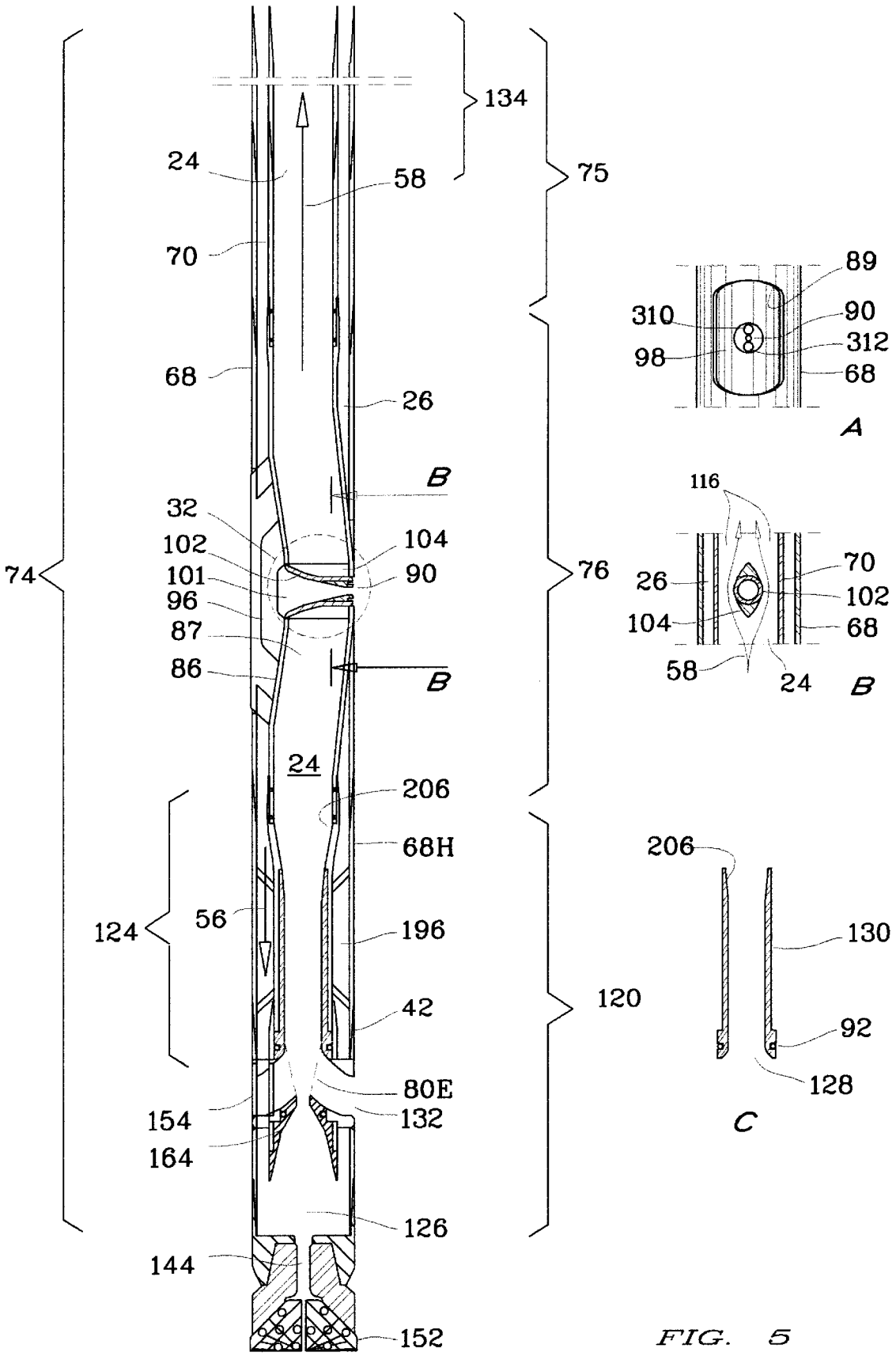
FIG. 5 is a side sectional view of the hydromonitor and eductor sections; A—is a front view of the hydromonitor nozzle area; B—cross section of the hydromonitor; C—side sectional view of eductor throat insertion; D and E—are cross sectional views of the hydromonitor section, illustrating its geometrical proportions and the cylindrical (D) and the oval (E) shape of the inner pipe.

The bottom head 74 is illustrated on FIG. 5. Below the hydromonitor section 76 is attached the eductor section 120 which includes a distribution reservoir 126, a nozzle 164, a Venturi pipe 124 and at least one slurry intake port 132. At the end of the tool 10 there is a drill bit 152.

It is preferred that the barrel portion 102 of the hydromonitor 32 be generally conical in shape, and will have round cross-section normal to the direction of the flow 56. Due to the generally conical configuration of the barrel portion 102, working fluid 56 entering the barrel portion 102 is accelerated through it as the flow 56 moves towards the nozzle 90. Thus, the water flow 56 will encounter the hydromonitor 32 through the maximum possible entrance area 101.

The acceleration of the water flow 56 trough the hydromonitor 32 occurs upon entering it and not only after flowing through the nozzle 90, as it was in the previous case. In other words: the process of water jet 80 forming starts earlier and, thus, runs longer. It will positively effect the water jet 80 structure, make it more compact and focused. It increases the water jet 80 work ability.

Figure 5D:
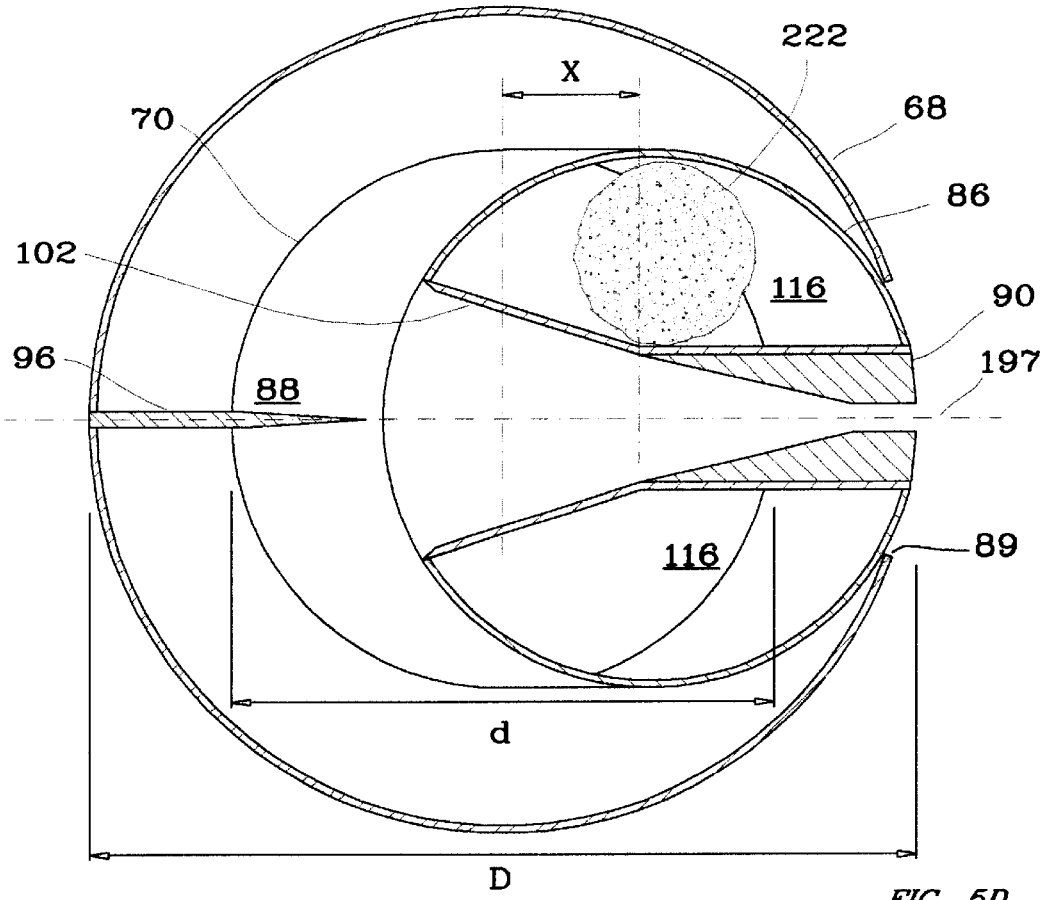
Figure 5E:
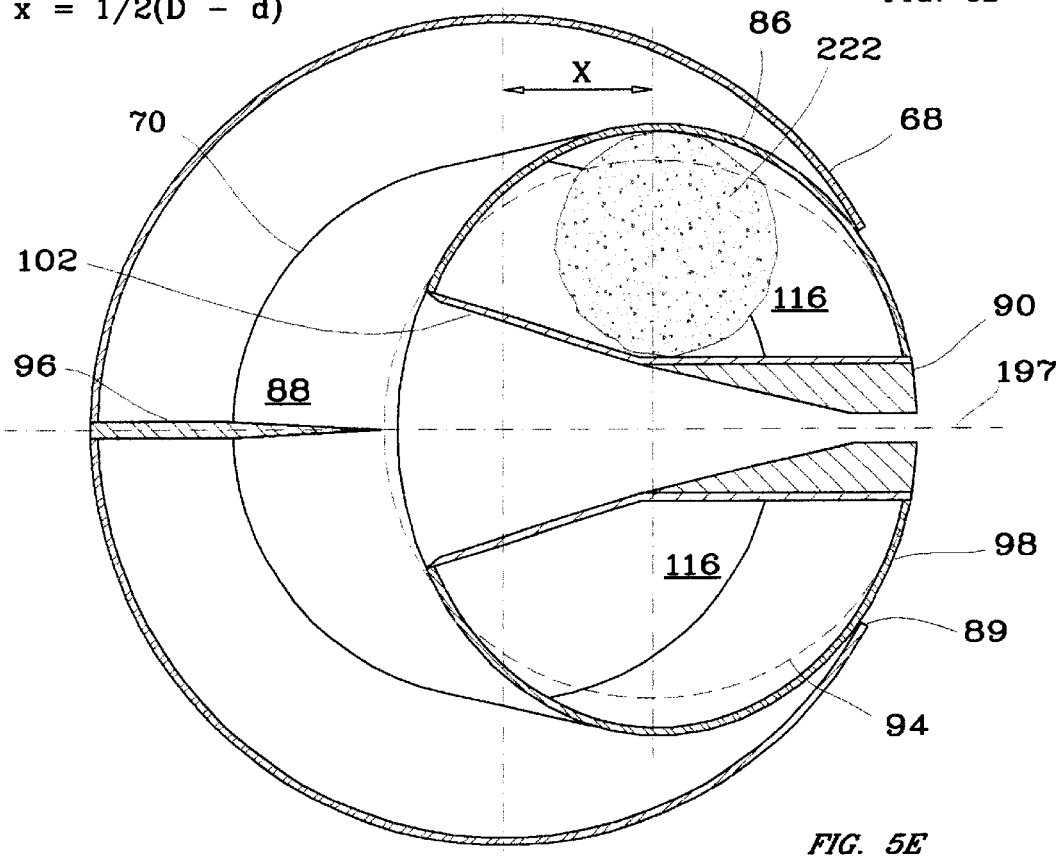

From examination of FIG. 5 it can be seen that the hydromonitor 32 extends through the slurry knee passage 86 of the hydromonitor section 76. The Hydromonitor 32 bifurcates the knee 86 to define a fork 87 with equal sized channels 116 (FIGS. 5D and E). Preferably, this fork 87 will be placed at the crest 98 part of the knee 86 (FIG. 5A). The crest 98 is the part of the Hydromonitor section 76 at which the internal fluid (slurry) knee passage 86 is closest to the external conduit 68H.

There are two smoother-stabilizers 104, mounted on outside surface of the barrel 102 portion of Hydromonitor 32 shown on FIG. 5B. The smoother-stabilizers 104 decrease the slurry turbulence range and, as a result, decrease the slurry pressure loss.

On FIG. 5C the eductor 120 throat insertion 130 is shown separately illustrating its main parts which are confuser 128 and diffusor 206.

From the FIGS. 5D and E, it can be understood that the maximum offset "x" that can be incorporated in a hydromonitor section 76 having two conduits, an external conduit 68H of diameter "D", and an internal conduit 70H of diameter "d", is described by the mathematics formula:

$$x=\tfrac{1}{2}(D-d).$$

In order to take full advantage of the ability to create a large area of concentrated flow 88, the preferred embodiment of the invention includes a window cutout 89 in the external pipe 68H to allow additional displacement of the internal pipe 70H for a distance equal to the thickness of the wall of the external pipe 68H, as show on FIG. 5.

On FIGS. 5D and E the advantage of the oval shape of the inner pipe 86 in the slurry fork crest area is shown in comparison with the standard cylindrical 94 shape (dashed line). The oval shape of the inner pipe 86 allows it to transport bigger size slurry chunks 222 through the forked channels 116.

Thus, the fork 87 incorporates a streamlined profile to produce smooth flows of both high pressure water 56 and slurry 58 through the Hydromonitor section 76. By including this smooth, streamlined profile and by providing a fork 87 at the knee 86, the slurry 58 bottom head (74) pressure losses are minimized, while increasing the overall efficiency of the whole tool 10 as explained above. This synergistic effect is largely due to the fact that the knee 86 provides a large exposure of the entrance 101 of the barrel 102 to the flow of working fluid 56. This increased exposure is due in large part to the use of the knee 86, which concentrates the flow of working fluid 56 at the entrance 101 of the barrel 102 in a smooth manner. Moreover, the smooth transition of the knee 86 reduces the head 74 losses caused by turbulence as found in traditional designs which simply place a Hydromonitor in fluid communication with a bent duct. All mentioned distinctive signatures: knee 86, stabilizer 96, conical barrel 102 and offset of the knee 86 decrease hydrodynamic turbulence and thus water pressure loss. In turn, it enhances the bottom head 74 and water jet 80 hydrodynamic characteristics (makes it more compact, focused) . As a result, it increases water jet pressure, the effective distance between the tool and the rock face and finally, it enhances efficiency of borehole mining.

The gap 26 (see FIGS. 2 and 3) is used to carry working fluid 56 down, or to carry slurry 58 up, depending on the general configuration of the tool 10. The outer pipe 68 of the bottom head 74 defines a gap 27 with the casing 114 which is sealed by the packer 36 located on the hub 67.

While borehole mining, the tool 10 is rotated in a hole 12 and moved up and down within the production interval 11. While pumping out the created slurry 58, underground cavities (caverns, stopes) 82 can be created. The bottom head 74 is assembled in such a manner that its length allows the pucker 36 always to stay above the casing's 114 shoe 115 while operating.

Figure 6:
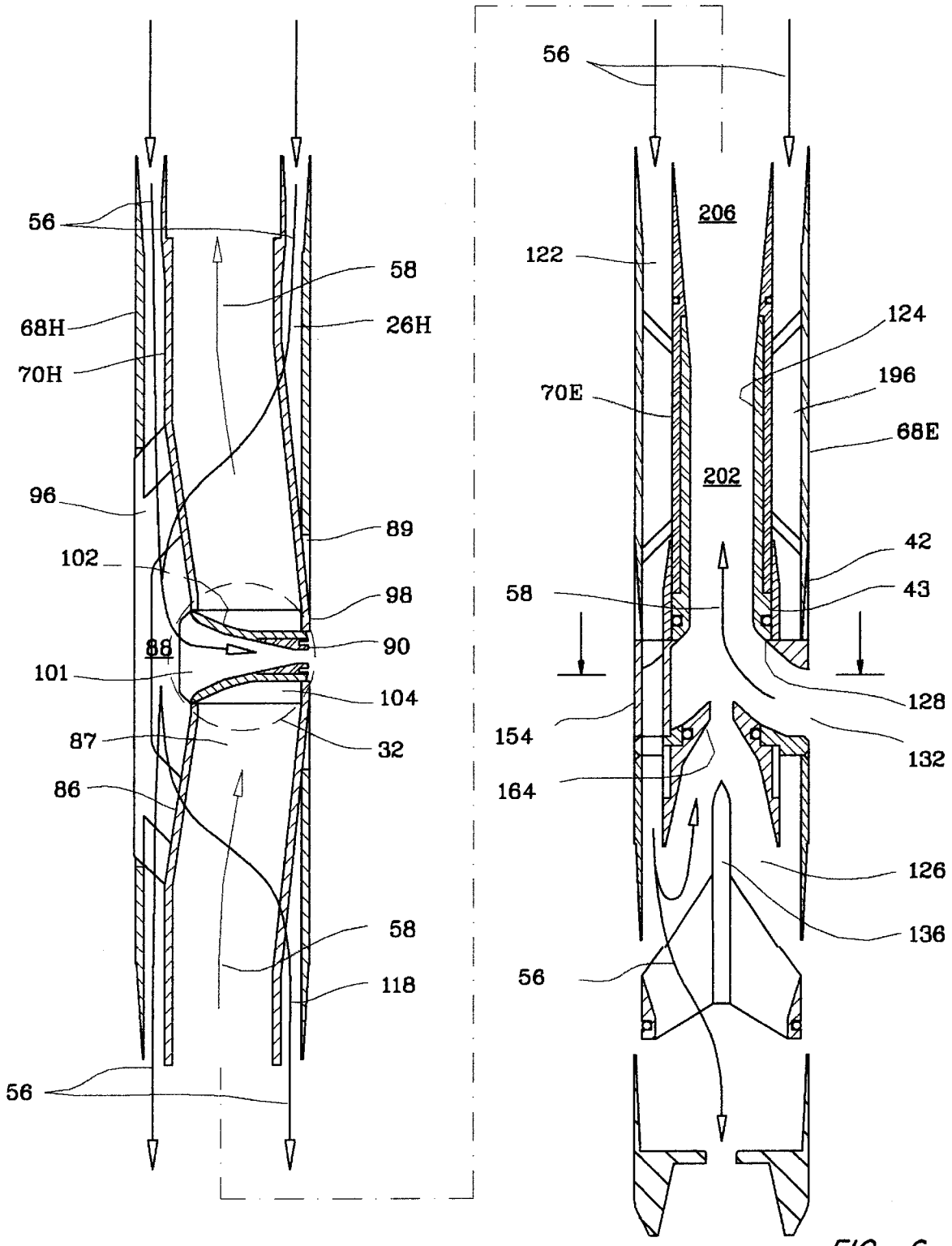
FIG. 6 is an enlarged side sectional view of the hydromonitor and the eductor sections.

In FIG. 6 bottom head main fluid flows are shown. In the Hydromonitor section 76 one portion of the flow 56 encounters to the hydromonitor 32 and going through it accelerates to a water jet 80 (see FIG. 1). This jet 80 cuts the rock material 11 which becomes slurry 58.

The other portion of the working water 56 continues flowing down and reaches the distributive reservoir 126. Working water 56 then makes a 180° turn and encounters the eductor nozzle 164 which creates the water jet 80E shown on FIG. 5. This jet creates a vacuum that inducts the incoming slurry 58 which firs encounters to the venturi pipe 124.

From the diffusor 206, the slurry 58 then enters to the knee passage 86 and then to the slurry channel 24 by which it finally reaches the ground surface 38 (FIG. 1). Here, in a collecting pond or tank 40 the slurry 58 is separated by itself or by any type special equipment (hydro cyclones, separators or other). The mined material 222 is then delivered to a customer of further development, and the clarified water 56 is pumped down to the hole 12 again, closing the tool 10 recirculating water supply system.

The internal conduit 70H includes a fluid knee passage 86 that carries the slurry 58 being retrieved as part of the mining operations. Because of the knee 86, working water flow 56 is diverted to one side of the Hydromonitor section 76, to the area of "concentrated" flow 88, where it will encounter a stabilization plate 96 and the entrance 101 to the hydromonitor 32. The hydromonitor 32 has a barrel portion 102 that accepts the working fluid 56 before delivering it to an interchangeable or removable nozzle 90.

The stabilizer plate 96 serves as a means for preserving low-turbulence (laminar type) flow through the Hydromonitor 32. It decreases the level of turbulence in the working water flow 56, which helps to produce more focused (and thus, more powerful) water jets 80.

By examining FIGS. 5, 6 it will be understood that in order to concentrate the flow 56 at one side of the Hydromonitor section 76, the internal fluid (slurry) knee-passage 86 is offset to produce a bent section. Knee 86 offsets in turn the Hydromonitor 32 towards its outlet (nozzle 90). Thus, the distance between the outer pipe 68H and the entrance 101 to the Hydromonitor 32 is increased. It laminates, or smooths the water flow 56 at this point, and together with the stabilizer 96 decreases the grade of turbulence and cavitation of the flow 56 going through the Hydromonitor 32.

As explained above, the hydromonitor section 76 houses the barrel portion 102, which in turn supports the nozzle 90. Preferably, the nozzle 90 will be interchangeable, allowing its replacement to develop the necessary flow pattern and ratio between Hydromonitor nozzle 90 and eductor nozzle 164, as required by the field conditions.

The hydromonitor section 76 has the same type and size connection devices on each end (FIG. 6). It allows a user to assemble the tool 10 without the Hydromonitor section 76. With this arrangement the user may draw fluid-like slurries or liquids from a borehole 12 or any another cavity, tank, vessel or reservoir. This shape of the tool 10 will perform the pump-out functions only, when no water jet cutting is required.

Having same type connection devices on both ends of the Hydromonitor section 76 allows a user to combine more than one Hydromonitor section 76 within the same bottom head 74. There may be two Hydromonitor sections 76, three of them, and so on. This embodiment of the bottom head 74 allows accelerate the rock cutting process and will find an application in building of storages in Salt domes, in creating of underground collectors or barriers and in a several more engineering and environmental projects.

Since the hydromonitor 32 receives only a fraction of the working fluid 56 flowing through the bottom head 74, the balance of the working fluid 56 is allowed another portion of it (56) to exit the Hydromonitor section 76 through an annular exit 118 shown on FIGS. 5 and 6. From this exit 118 the working fluid 56 then travels to an annular entrance 122 of an eductor 120 section.

Analyzing the FIGS. 5 and 6 it also can be understood that working fluid 56 flows from the Hydromonitor section 76 into the eductor section 120. From here it flows through the connector 42 to any additional part attached to the bottom head 74 of the tool 10.

The eductor section 120 allows modification of the tool 10 for specific operations to be carried out. Referring now to FIGS. 1, 2, 4, 5, and 6, it can be understood that the eductor section 120 also includes external 68 and internal 70 pipes. The relationship between these two pipes is maintained by stabilizer plates 196.

The internal pipe 70E of the eductor section 120 (FIG. 6) houses a Venturi pipe 124 which is used to create a vacuum to draw slurry 58 and to perform the various other functions of the borehole mining tool 10. The Venturi pipe 124 includes a confuser 128, a mixing chamber (throat) 202, and a diffuser 206. The confuser 128, the mixing chamber 202, and the diffuser 206 are incorporated into an interchangeable insertion 130 shown separately on FIG. 5C. By varying the diameters of nozzles 90, 164 and the insertion 130, the proportion of the working water 56 volume going through the Hydromonitor 32 to the volume going through the eductor section 120 can be controlled.

The Venturi pipe 124 receives a maximum abrasive wearing while mining. Interchangeable embodiment of the insertion 130 allows simple replacement when necessary. In other words—replaceable embodiment of the Venturi 124 simplifies the maintenance of the eductor section 120.

The eductor section 120 has a universal connector 42, located at the bottom end of the Venturi pipe 124. This connector 42 allows attachment of additional equipment to the bottom head 74 which makes wider an application area of the entire device. In other words, this connector 42 allows modification of the eductor section 120 in order to adopt the borehole mining tool 10 for a specific technique or technological task. Thus, the versatility of the instant device is achieved by providing the eductor section 120 by the universal connector 42.

One useful embodiment of the universal connector 42 consists of a conventional thread on the outer pipe 68E, and slide-in hermetic coupling 43 on the inner pipe 70E.

Figure 7:
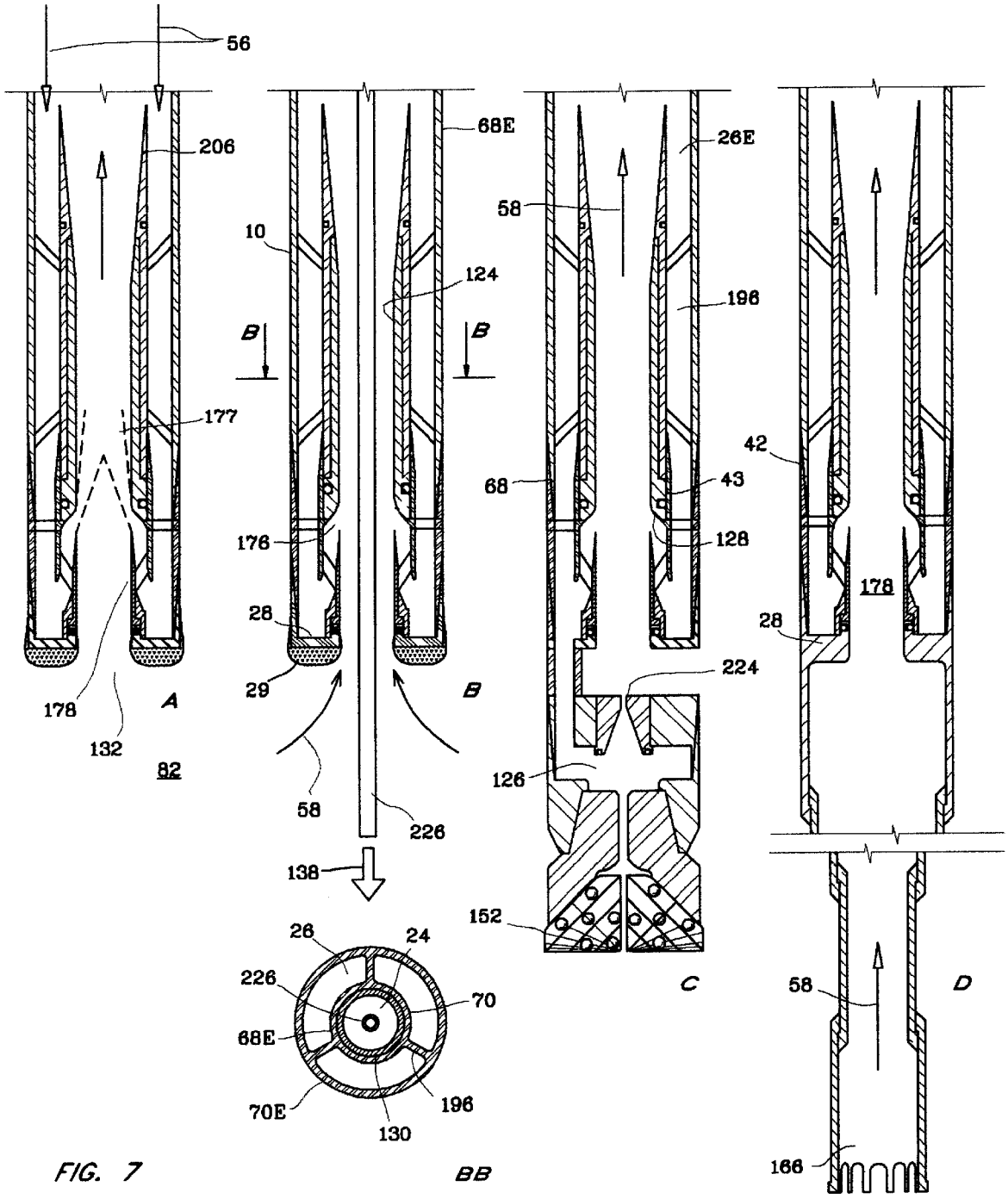
FIG. 7A illustrates a ring eductor nozzle and a sucking aperture at the tool's bottom point.
FIG. 7B—the same as 7A but with the secondary working agent duct going through the eductor nozzle.
FIG. 7C is the same as 7A, but with an accelerating nozzle and a drill bit.
FIG. 7D is the same as 7A, but with the telescopic sucker.
Figure 8:
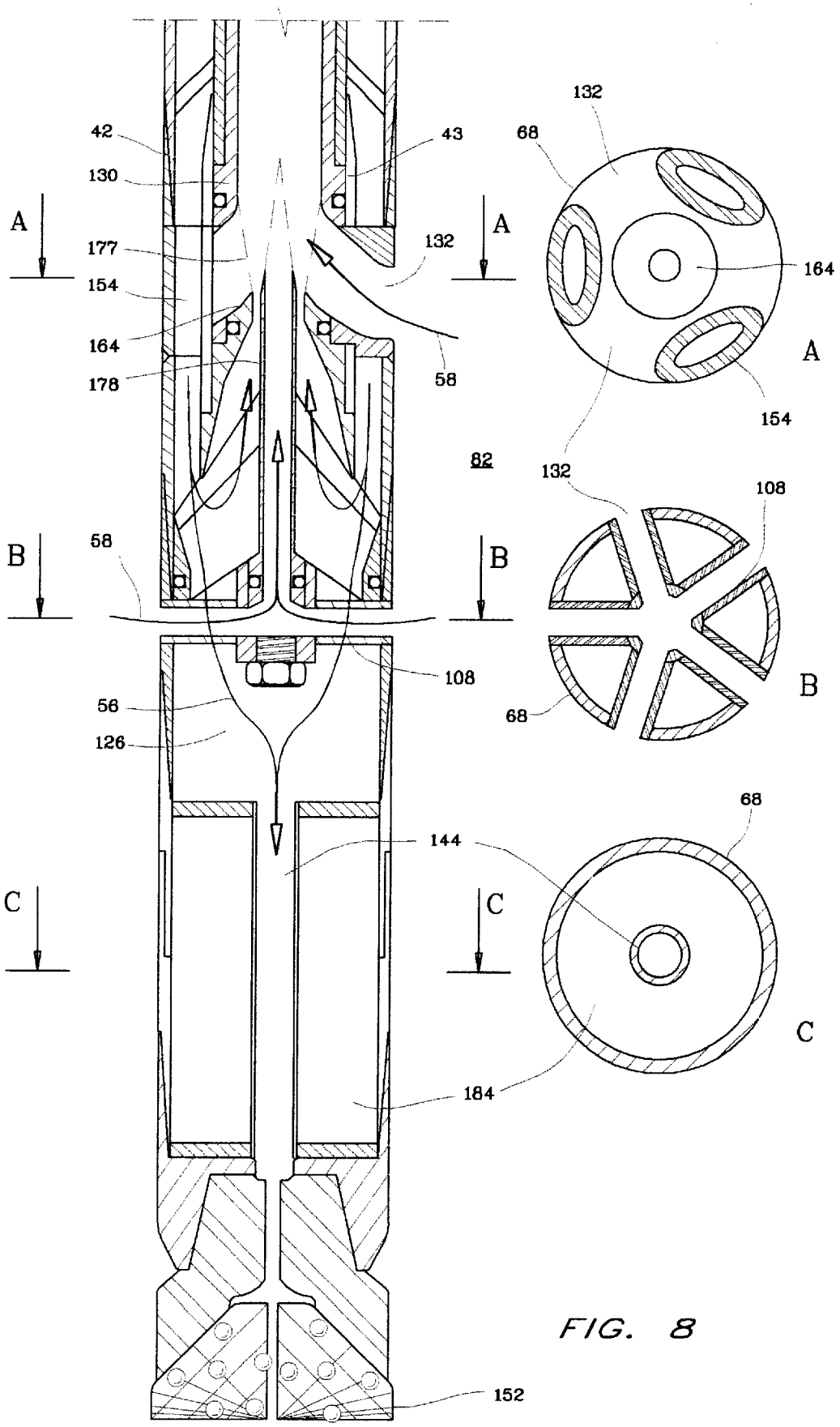
FIG. 8 is the side sectional view of the bottom part of the tool with a draw tube-needle, extra slurry intake ports, a positioning system compartment and the drill bit, A, B and C are cross sections as indicated.

FIGS. 7 and 8 illustrate different embodiments of the device bottom part allowing by universal connector 42, where:

FIG. 7A presents bottom face ring-type eductor with the lowest possible suction area and two faces eductor jet 177;

FIG. 7B presents the same as A but with the extra duct 226 ending below the tool 10, BB is the cross section view through the venturi pipe 124;

FIG. 7C is the same as A, but with the auxiliary nozzle 224;

FIG. 7D the same as A, but with the telescopic sucker 166.

FIG. 8 illustrates draw needle-stabilizer, extra slurry intake ports 132 and an electronic compartment installed between the distribution reservoir 126 and a drill bit 152.

Figure 9:
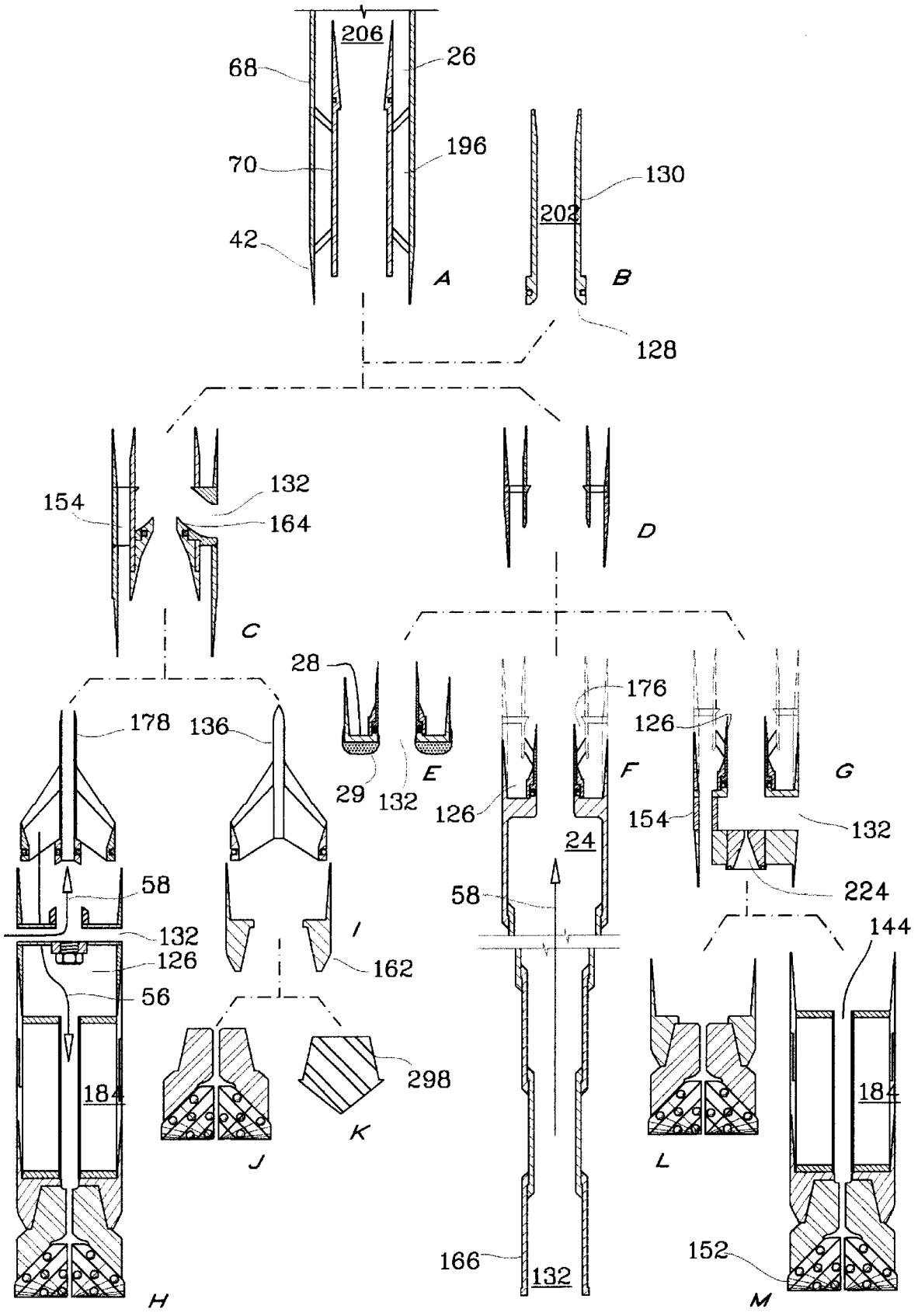
FIG. 9 is a plurality of side cross-section views of the tool.

FIG. 9 illustrates sequence of the instance device bottom part assemblies which allow it perform different exploration, mining, environmental and other tasks. Analyzing FIGS. 1 through 9, it can be seen that whole plurality of different tool 10 bottom head 74 assemblies is based on two main embodiments of the eductor section 120. They are: central (FIG. 9C) and ring (FIGS. 9D/E) types. These eductors form respectively solid 80E (FIG. 5) and annular 177 (FIG. 4) water jets which perform different hydrodynamic characteristics and found application in different areas.

Also, it should be mentioned that the positioning system compartment 184 can be attached to the tool 10, regardless of the type of the eductor section 120, as illustrated on FIG. 9H and M.

Figure 10:
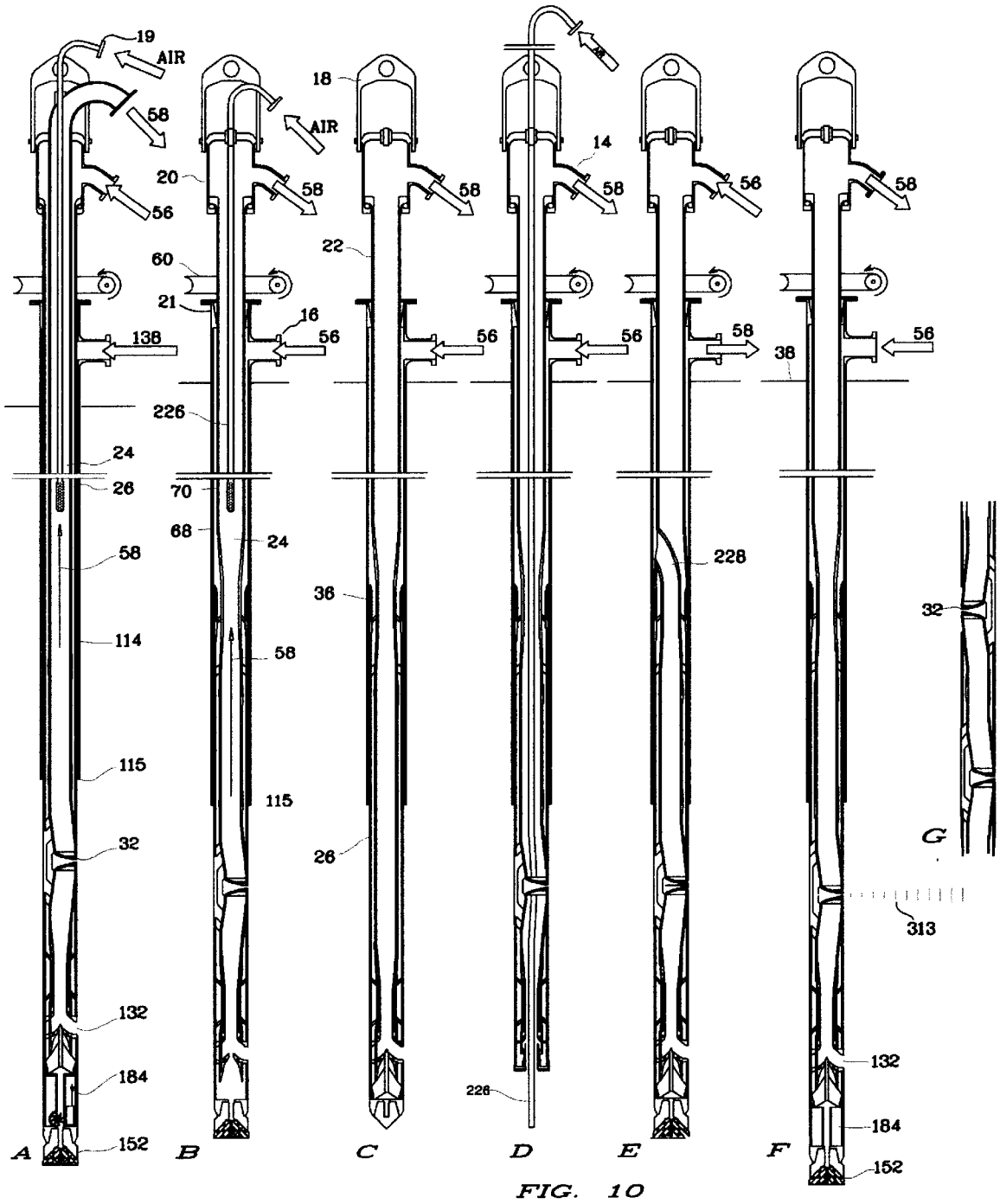
FIG. 10—samples of different assembling of the tool to illustrate versatility of the invention.

On FIG. 10 are presented several different modifications of the tool 10. They are: A—preferable "light" configuration including straight hub, hydromonitor and eductor sections; B—the same with additional (third pipe) air duct with aerator 180 at its end to create an airlift effect; C—the same as A but without the hydromonitor section, an airlift and a drill bit; D—the same as B but with the end-face (ring-type) eductor with the very bottom suction area and the secondary agent duct ending below the tool; E—the same as A but with the reverse hub and surface equipment communications, F—the same as A but with positioning system and G—illustrates two Hydromonitor sections joined serially. The tool embodiment presented on FIG. 1 should also be counted as the most complete and thus most powerful configuration of the instant device.

As it was noted above, usually next to the Venturi pipe 124 a distribution reservoir 126 is located. At least one water pass duct 154 is installed between the Venturi 124 and the distribution reservoir 126. The distribution reservoir 126 serves as an interchangeable or modifiable means for diverting the flow of the working fluid 56 to the desired passage. This allows the flow of working fluid 56 to enter different tool's 10 parts such as the eductors's nozzle 164, drill bit 152 or any other implement attached to the bottom head 74.

The area between the eductor nozzle 164 and confuser 128 has at least one hydraulic connection to the well 12 or stope 82 (see for example FIG. 1). This connection defines at least one (single) slurry intake port (inlet) 132. Thus, the vacuum sucks the slurry 58 through intake 132 from the driving cavern 82 and directs it into the eductor confuser 128. From the confuser 128 the slurry/water mixture (56/58) then proceeds to the mixing chamber 202 where they are mixed together and than continue on to the diffusor 206.

Figure 10H:
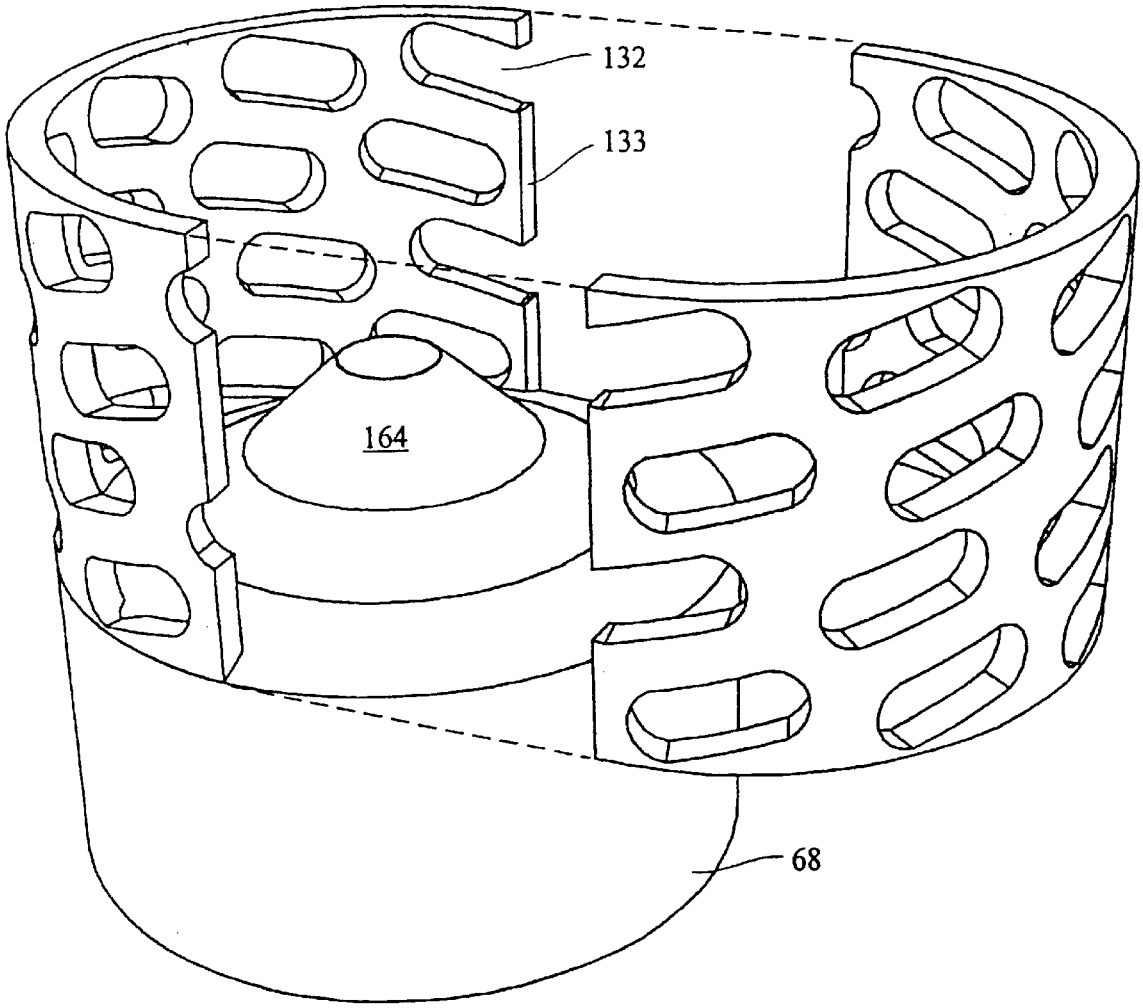
FIG. 10H—presents interchangeable protecting-calibrating grill-net screens.

The aforementioned slurry intake port 132 may have interchangeable protecting-calibrating grill-net screens 133 presented on FIG. 10H. The screens' dimensions are equal or less than slurry channel minimum cross section. Thus, the screen(s) sort slurry 58 material and protect the slurry channel 24 from plugging by unconditioned chunks 222.

As shown on FIGS. 1, 2, 4, 6 and 10A, C, E and F, the eductor nozzle 164 may include a fixed needle 136, which is used to create an annular water jet 177, shown on FIGS. 4, 5 and 8. It has been discovered that the one of the most important characteristics which determine the eductor's vacuum (suction ability) is the diameter of the water jet. In borehole mining, this parameter is in turn limited by the diameter of the well. In other words, there is always the maximum (limit) of the water capacity which can be pumped through the tool with its instant (given) diameter. This problem can be solved, however, by inserting a pipe (U.S. Pat. No 4,934,466) or a needle (U.S. Pat. No 4,059,1066—Bunnelle device) inside the eductor nozzle. This inserted cylindrical body occupies the central area of the water jet and allows it increase its diameter. Thus, increased suction can be achieved while pumping the same volume of water. Thus, the needle 136 allows to increase the tool 10 work ability.

The instant invention also offers another eductor section 120 embodiment based on the above mentioned discovery. On FIGS. 7 and 10D the ring-type eductor is presented. Next to the universal connector 42 and the distribution reservoir 126, an annular nozzle 176 is attached. Nozzle 176 is formed by the plug 28 and the needle-draw tube 178. The plug 28 blocks the gap 26E, and together with the draw tube 178 directs the whole working water flow 56 upward to the confuser 128 of the Venturi pipe 124. Thus, the annular nozzle 176 creates an annular water jet 177, the inner space of which is connected to the mining area 82 by the drawtube 178. It is noteworthy that this drawtube 178 works the same as the needle 136, shown for example on FIG. 4. The only difference is—that the hole (intake port) 132 connects the confuser 128 to the stope 82. In other words, the drawtube 178 is the same needle 136 but contains the hole-connecter (intake port) 132. Finally, the draw pipe 178 locates in the middle of the bottom-end face of the tool 10. This arrangement allows the tool 10 to draw material from the very lowest point of the working area 82. The outer face of the plug 28 (tool 10 end-face) is armored by the rock-breaking material 29. It enables a user to re-drill collapsed intervals while mining when necessary.

In practice some of slurry particles 222 flowing down under gravity can miss the standard eductor 120 vacuum area, reach the sump 250 and avoid extraction. This is even more likely as the diameter of the stope 82 increases and/or tool 10 is lifted while operating. On FIG. 7D the telescopic sucker 166 is presented. This sucker enables to keep the slurry 58 intake port 132 at the stope's 82 sump 250 area constantly while tool 10 is elevating and lowering in the hole 12 while operating. Thus, this extendable telescopic trunk-sucker 166 delivers one more extra (specific) operational property to the tool 10: slurry sucking remote ability.

It has been also discovered that the double faced annular jet has greater suction ability than the single (solid) one. It is due to the double vacuum created by the both faces of this jet. On FIG. 8 the doubled slurry intake 132 area is presented. As it shown, both faces of the water jet 177 are hydraulically connected now to the same working space 82. The outside surface of the jet 177 is connected by the intake port 132. The second connection is achieved by the needle-draw tube 178 placed coaxially inside the standard "central type" nozzle 164. The bottom part of this needle 178 is connected to the stope 82 space by radial draw pipes 108. After the distribution reservoir 126, one portion of the high pressure water 56 flows upward to the annulus gap between the nozzle 164 and the needle-draw pipe 178. The other portion of water 56 continues flow down around the radial draw pipes 108 and through the channel 144 reaches the drill bit 152. It should be mentioned that the drill bit 152 can be attached directly to the distribution reservoir 126. The slurry 58 now encounters the tool 10 not only through the slurry intake port(s) 132, but through the end faces of the radial draw pipes 108, as well. In other words, now both faces of the water jet 132 draw slurry 58 from the stope 82. This arrangement allows the eductor to increase its sucking ability, while enhancing the whole BHM process productivity.

Referring again to FIG. 7C, it can be appreciated that the gap plug 28 is able to accept additional components that will cooperate with the distribution reservoir 126. For example, an annular nozzle 176 has been combined with an auxiliary-accelerative nozzle 224. The auxiliary nozzle 224 provides a propulsion boost to help move slurry 58 up past the annular nozzle 176 and towards the Venturi 124.

FIGS. 7B and 10D illustrate the use of a flexible secondary agent (138) delivery tube 226 in use with the annular nozzle 176. The tube 226 may be used to deliver fluids and mixtures, such as concrete, leaching agents, air, Nitrogen or another gases, foam, clay mud and other secondary agents needed for a specific task to be carried out with the tool 10.

Thus, with the variations of the distribution reservoir 126 it has been taught herein a variety of tool 10 modifications may be assembled.

As was mentioned earlier, borehole mining is carried out through pre-drilled and cased holes. Usually, the pre-drilled borehole already has some above-the-earth equipment, especially in the oil and gas industry. This equipment, known in the field as a "Christmas tree", prevents oil/gas leakage and explosion, and at the same time allowing operation in the hole "under pressure". The trees construction allows it to be connected to the borehole mining tool by either direct or reverse schematic, as described earlier. Thus, the BHM tool, which construction is based on direct schematic, may not be applied on the hole with reverse Christmas tree, and opposite. In such cases, the tool requires either the additional equipment, or a complete reconfiguration, or a different type BHM tool. Thus, another distinguishing feature of this invention can be achieved by variation of embodiment of the hub 67 presented in great on FIG. 11, allowing assembly the tool 10 for direct or reverse fluid circulation.

Figure 11:
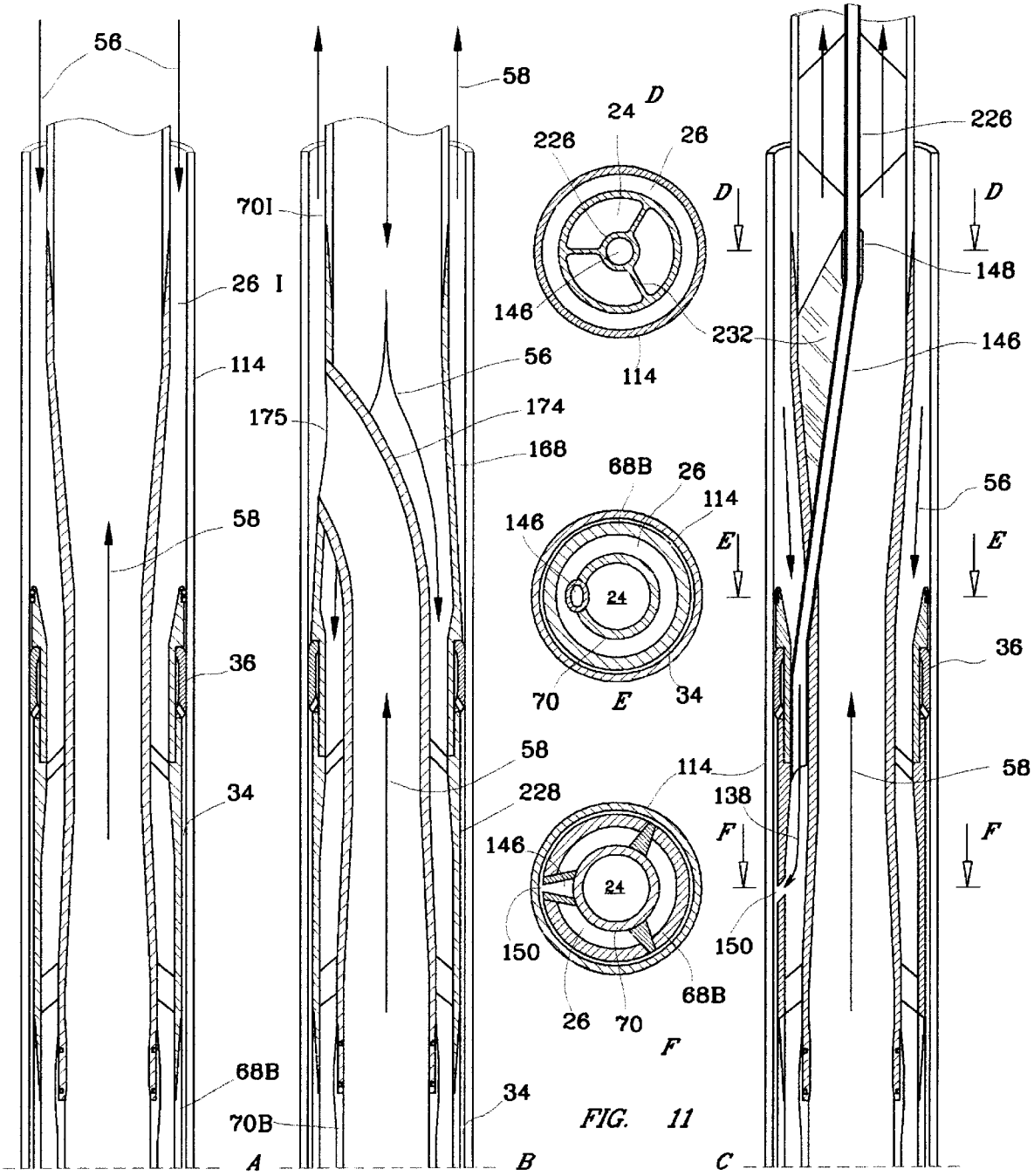
FIG. 11 is a side and cross sectional views of the different hub embodiments.

On FIG. 11 the direct (A) and the reverse (B) hub 228 modifications are shown. The construction of the reverse hub 228 is described as follows. The main part of the hub 228 is a truncated cone 168, hydraulically connecting the inner column 70 of the intermediate section 64 to the gap between the bottom head's 74 external pipe 68B and internal pipe 70B. This detail not only pertains to the hydraulic connector between said parts, but also a main detail of the bottom head 74 suspension suspending it (74) on the inner column 70I. Also, it is the one of main detail, transmitting a torque from the turntable 60 to the drill bit 152. Inside of this cone 168 the slurry-pass stub pipe 174 is mounted connecting the bottom head 74 inner pipe 70B to the intermediate section 64 gap 26I between the casing 114 and the inner column 70.

This hub 228 and port 175 allows to switch (replace) fluids 56 and 58 in the tool 10 main fluid channels (24 and 26) and reverse these fluids flow directions in these mentioned channels (24 and 26) within top head 52 and intermediate section 64. Now, (see FIG. 11B) the water 56 goes down to the bottom head 74 by the inner pipe 70 and the slurry 58 is raising-up by the gap 26. It should be noted that the reverse hub 228 does not cause any changes in the bottom head 74 fluids circulation. Thus, the reverse hub 228 solves only the tool 10 surface equipment connection problems. Both direct (FIG. 11A) and reverse (FIG. 11B) hubs have said pucker 36.

Casing surface usually is very rough, covered by rust, oil, paraffin and other sediments. Because of the constant rotation and sliding up and down of the tool 10 in the hole 12 while borehole mining, the packer 36 contacting surface is subjected to severe wear. To decrease this, the packer 36 is embodied with possibility of rotation relative to the tool 10. The hub 67 surface under the packer 36 (FIG. 12) is polished and sealed by rubber rings 92. Because the friction force between packer 67 and the tool 10 (actually—the hub 67) is much less than between the rusted casing 114 and said packer 36, the last (36) will rotate relative to the tool 10 rather inside of the casing 114. In other words, the packer 36 will remain stationary relative to the rough casing 114 and will rotate relative to the polished hub 67. It will increase the packer 36 life and work ability.

Figure 12:
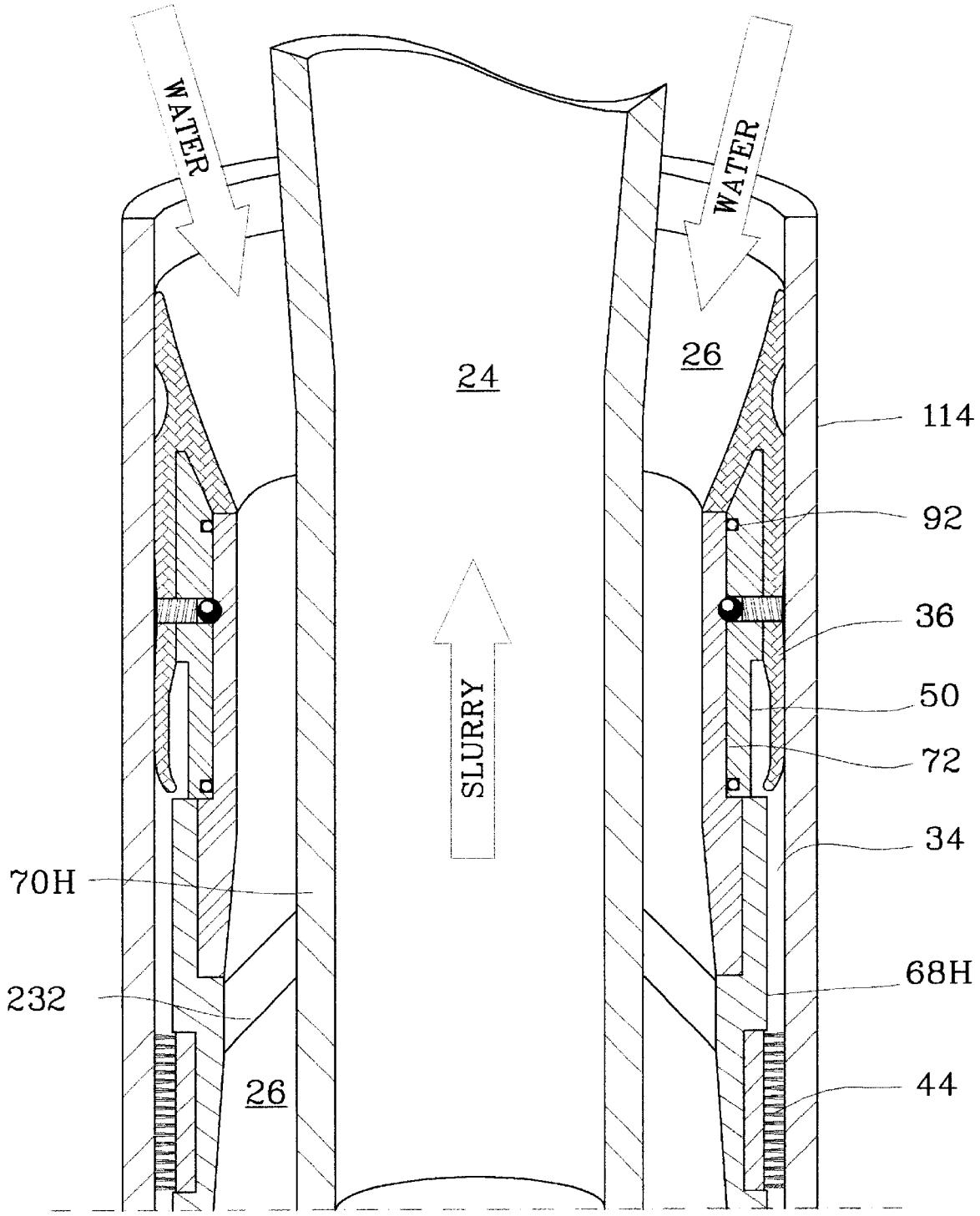
FIG. 12 is a greater view of the packer zone of the straight hub.

Also, to prevent wearing of plastic or rubber packers and increase their life, below the packer 36 some cleaning elements are mounted, for example metal brush 44 (FIG. 12). While lowering the tool 10, its rotation in a hole 12 and moving it up and down while operating, these cleaning elements 44 clean the casing 114 face to help mitigate the packer 36 wear.

Some hydro geological and technological conditions require a secondary working agent 138 to be injected into the driving space 82. For example nitrogen—to prevent Methane explosion, or compressed air—to create an extra pressure (pressurizing) above the slurry level 142 in a stope 82, to help for eductor 120 to pump up the slurry 58. On FIG. 11C a secondary agent bi-pass channel 146 is presented installed inside of the hub 67. This channel 146 has a hold box 148 at its upper end to accept the secondary agent duct 226. The bottom end of this channel 146 is connected to the gap 27 between the bottom head 74 and the casing 114 by means of an outlet slot 150 located below the packer 36.

The secondary agent duct 226 is lowered down inside of the inner pipe column 70 after the tool 10 is assembled in a hole 12 until the duct 226 bottom end reaches the hold box 148. The secondary agent 138 being pumped from the surface is going by the bi-pass channel 146 and through the outlet slot 150 encounters the annulus gap 27. From here (27), the secondary agent 138 reaches the working space (stope) 82 and effects the borehole mining process. It should be mentioned that this shape of the tool 10 allows not only a user to pump-in a secondary agent but also recover any type of bi-product (such as a liquid or gas) if necessary.

Figure 13:
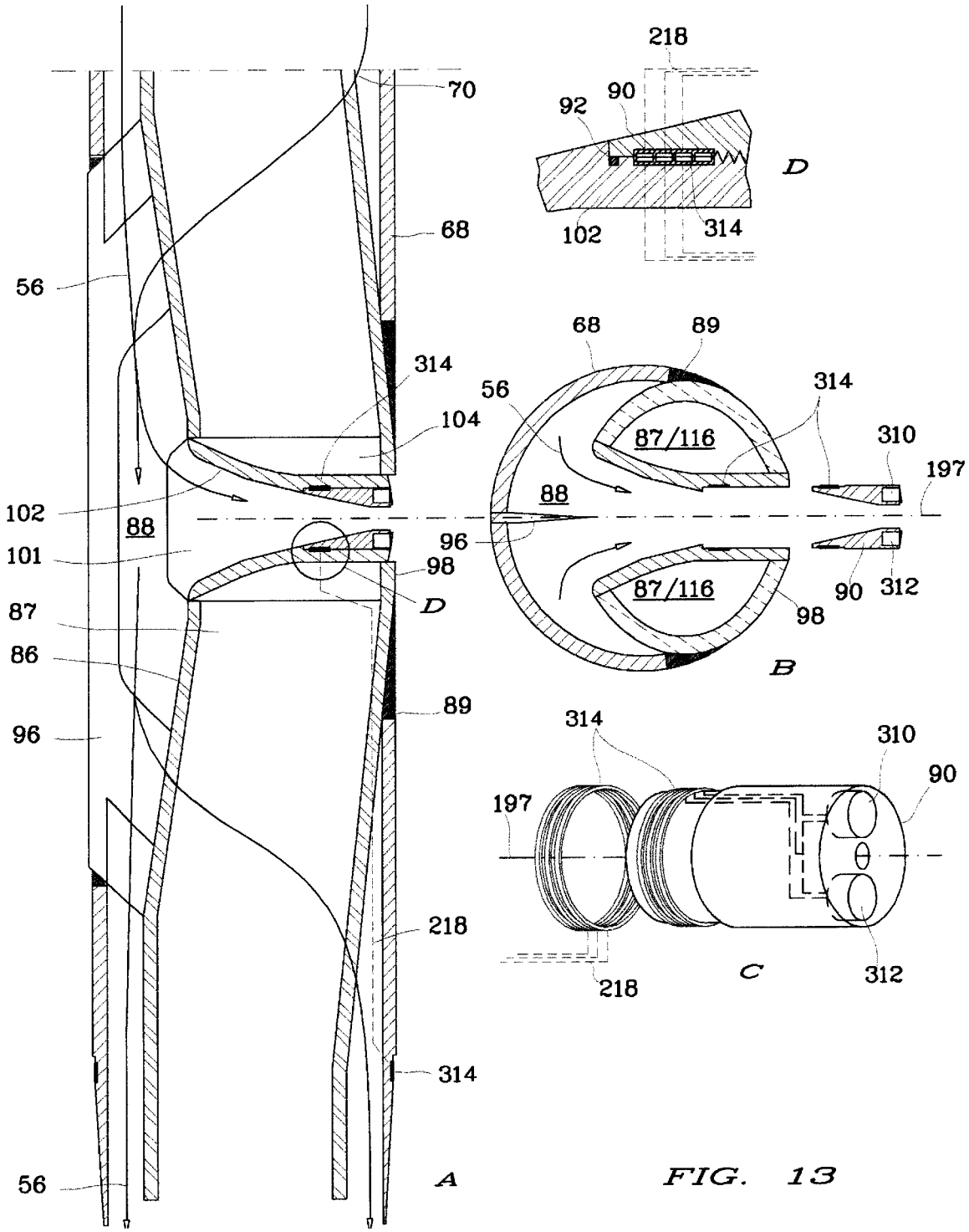
FIG. 13 is an enlarged view of the hydromonitor area and the removable nozzle with a radar sending (transmitter) and receiving (receiver) unit(s) as used with the positioning system; A—side section view; B—cross section; C—3D view of the nozzle and electrical contact rings; D—is enlarged view of contacts.

A preferred embodiment (FIG. 1) of the universal borehole mining tool 10 will be capable of collecting data as to the geographical orientation of the hydromonitor 32 as well as the distance between the nozzle 90 and any solid ore face 308 (radius of cutting). FIG. 13 illustrates mounting of radar elements inside of the hydromonitor section 76. These radar elements include: transmitter 310, receiver 312, wiring 218 and ring contacts 314.

Figure 14:
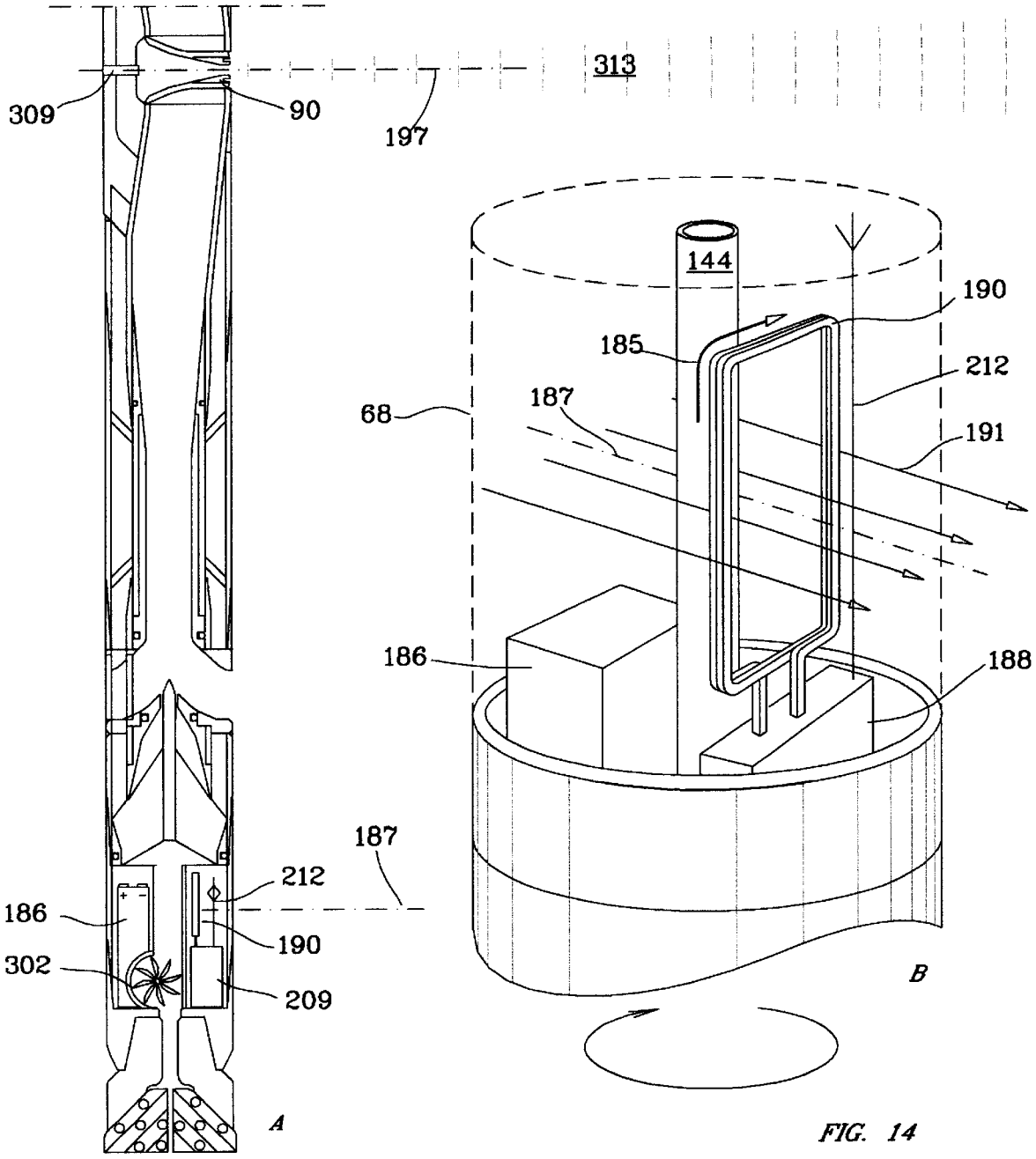
FIG. 14 is a side (A) and a 3D (B) views of the electronic compartment and a conductive loop as used to obtain orientation information on the position of the nozzle and other components of the tool while in use.

Referring now to FIG. 14 it will be understood that the distribution reservoir 126 of the eductor section 120 may accept an attachment such as an instrument enclosure 184. The instrument enclosure 184 has been adapted for receiving a battery pack 186 and a positioning system 188.

Figure 17:
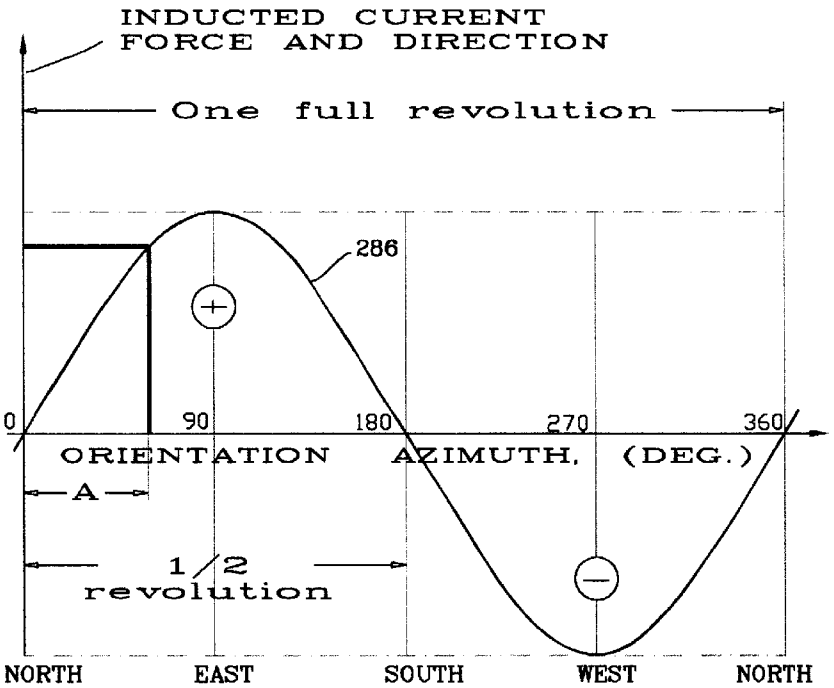
FIG. 17 illustrates the principal working of the tool positioning system based on geographical coordinates: A—presents a tool and cavern plan cross section as (in) a Polar coordinates system; B—is an inducted current sinus graph and its interpretation.
Figure 17:
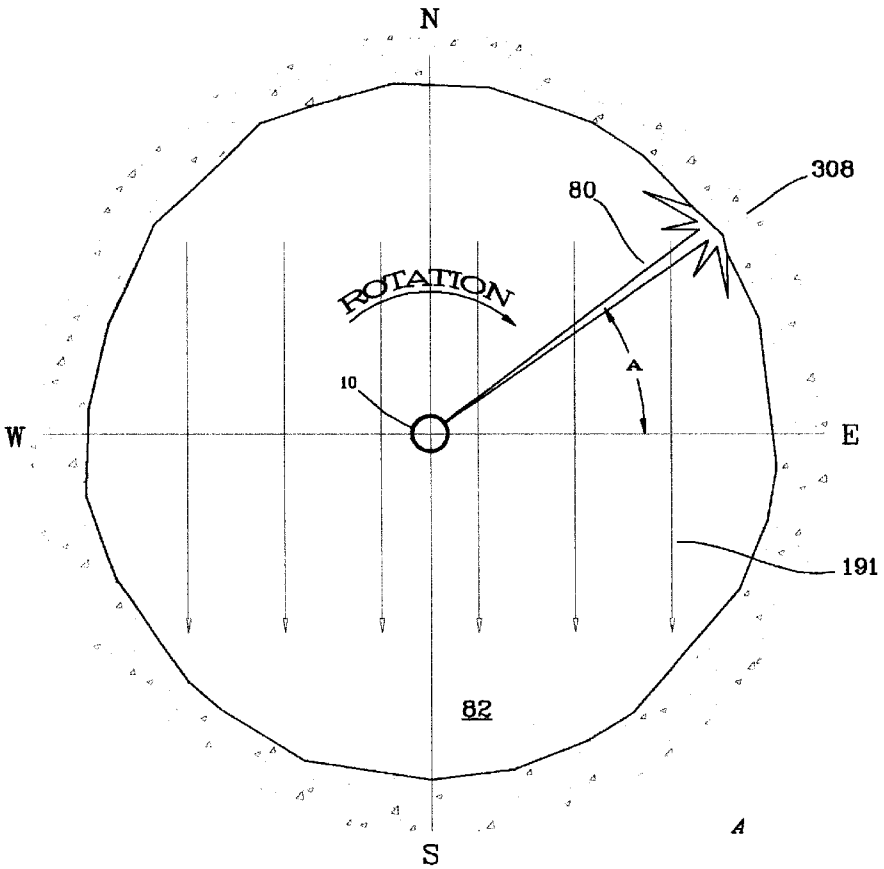

The positioning system 188 uses a conductive loop (or coil) 190 which is preferably placed within the instrument enclosure 184. Since the conductive loop 190 is held within the instrument enclosure 184, and the instrument enclosure 184 is rotated together with the rest of the tool 10, the conductive loop 190 will be rotated together with the tool 10. This rotation of the loop 190 will vary the orientation of the conductive loop 190 relative to the earth's magnetic field 191. By rotating the conductive loop 190 into the earth's natural magnetic field 191 one can induce (generate) a current 185 to flow through the conductive loop 190. This current 185 will be in a sinusoidal 286 wave form (see FIG. 17). Thus, by detecting these waveforms 185 one can determine the orientation of the entire tool 10 assembly relative to the earth's magnetic field 191 or its geographical orientation.

The positioning or determination of the direction of the nozzle 90 is explained in details on FIGS.14, 15, 16 and 17 and occurs as follows. As the conductive coil 190 rotates in the Earth natural magnetic field 191, a current (alternating current—AC) 185 is produced. The force and direction of this current 185 depends on the instant angle (orientation) of the coil 190 relative to magnetic field force lines 191. At the same time, the frequency of the current 185 is equal or proportional to the tool 10 rotation speed.

The coil 190 is mounted in a such a manner, that its axis 187 is parallel to the nozzle 90 axis 197 and oriented to the same direction as the nozzle 90 (FIG. 14A). During a single rotation (360 degrees phase) of the tool 10 in the well 12 the force of current 185 reaches extremes (positive and negative) twice following sin 286 graph Y=SinX (FIG. 17B). According to the theory [1], the maximum of current 185 force (see FIG. 17B) corresponds to the nozzle 90 direction (azimuth) to the East, minimum—to the West, first (after minimum) "zero" corresponds to the direction to the North, and second "zero" (after maximum)—to the South. All intermediate points (the points that are located between "zeros" and extremum) on the sinus curve (each) determines/belongs to a certain and only azimuth or tool 10 orientation. In other words, each point on a sine curve 286 gives the information about the current direction, in which the coil 190 is oriented in the instant moment. Because the coil axis 187, the nozzle 90 and entire Hydromonitor 32 are parallel to each other, the Sinus line 185 gives an information about the instant direction of the water jet 80 or direction of cutting in the instant moment.

Figure 15:
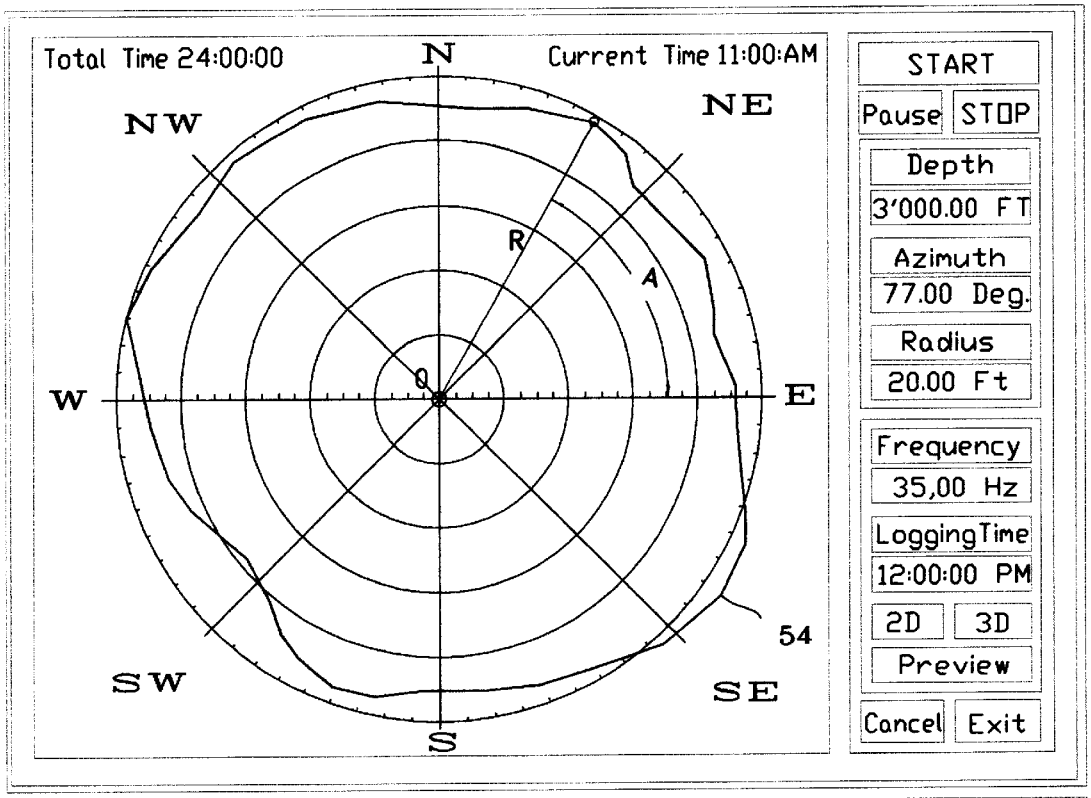
FIG. 15 presents a computerized image of the driving space at the current moment: A—plan view; B—3D view.
Figure 15:
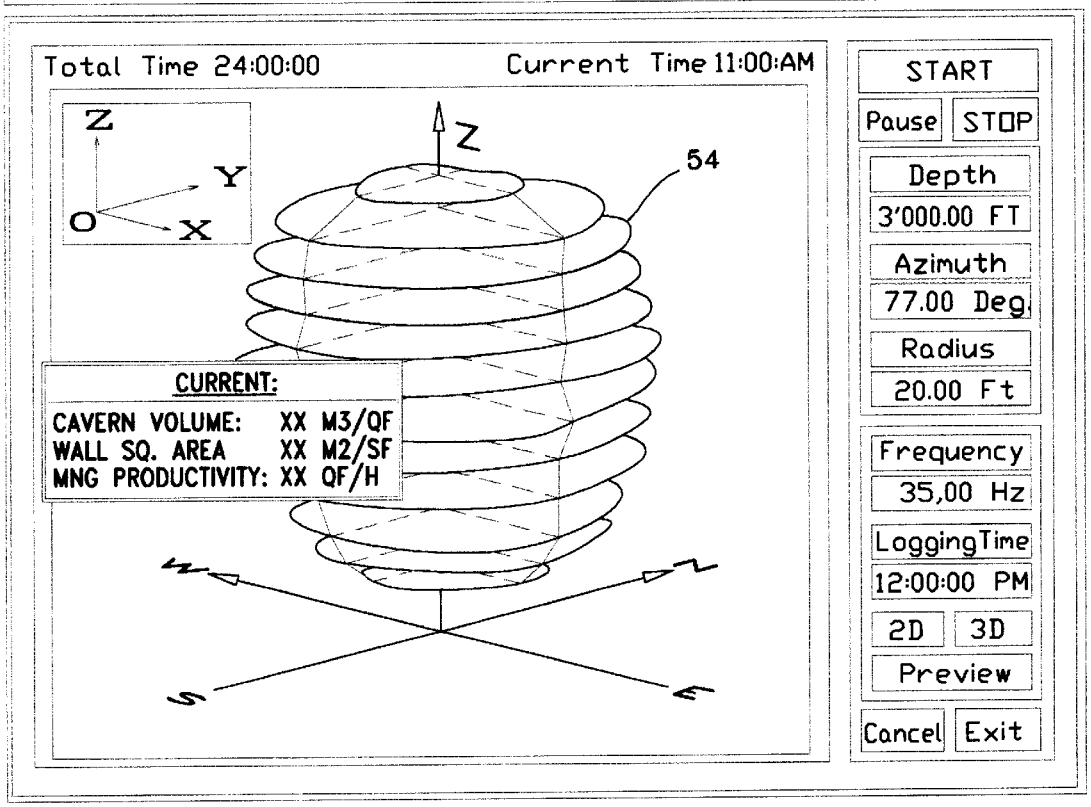
Figure 16:
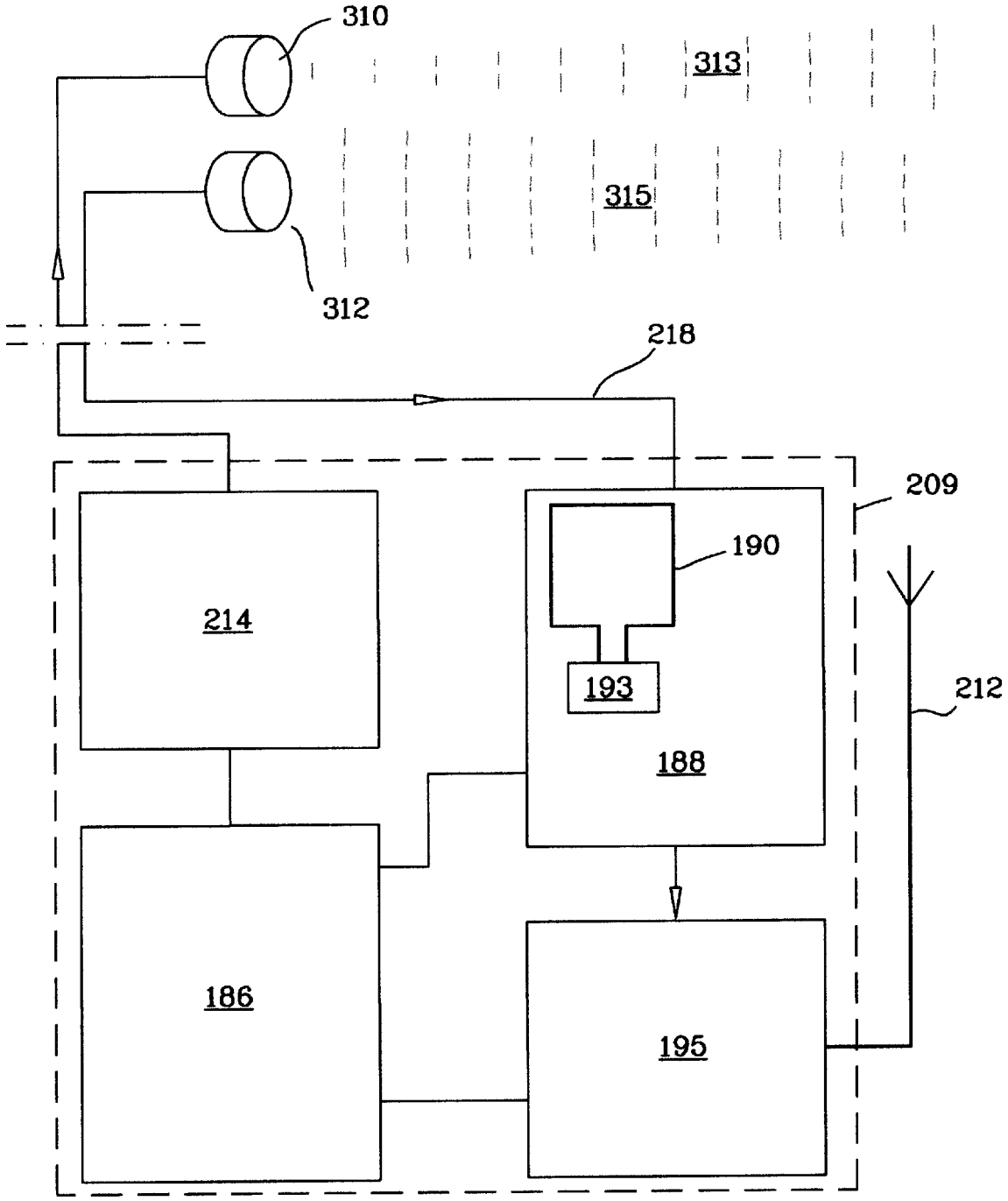
FIG. 16 illustrates one possible configuration for wiring of the transmitter and receiver included in the hydromonitor nozzle shown on FIG. 13 as well as electronic compartment enclosure shown on FIG. 14 for carrying out the radar sending and receiving signals as well as the positioning for the whole tool in a borehole while operating.

From the conductive coil 190 the current 185 arrives to the amplifying transformer 193. Then, amplified signals from the transformer 193 arrive to the radio transmitter 195 with antenna 212. From there it arrives to the earth's surface 38 in a kind of a radio signal. Here, in the decoder 201 this radio signal is transformed into computer signal (signal, accepted by a computer) and being developed by a computer 205 arrives on the monitor screen 207 (FIGS. 1 and 15).

The transmitter 310 is periodically activated by impulses produced by an impulse generator 214 which is controlled by radio from the earth's surface 38.

Practically, the speed of rotation of the tool 10 in a hole 12 is never equal to the frequency, generated by generator 214. Thus, the transmitter 310 sends a signal (penetrates the stope 82 or makes a measurements in it) each turn in a new direction (geographical azimuth). Additionally, the tool 10 is moved along the well 12 up and down, so that the direction of each new gauging differs from the previous one not only by the azimuth A, but also by the depth (distance from the Earth's surface 38). All this data enables more complete information about the instant configuration of the cavern 82, to develop its 3D computerized image (FIG. 15B).

The received information about the radius of the cavern 82 arrives to the computer 205 in the same manner as the orientation signal. On its screen 207 this signal gives a point on the line R of the azimuth vector, equal to the distance between the tool 10 and the rock face 308 (instant radius of the cavern 82). The consecutive connecting (joining) of this points (R) gives a plane configuration (structure, contour) of the cavern 82 (FIG. 15A) on this given depth (elevation). Thus, each gauging (penetration) of the cavern 82 gives the R—radius of the cavern 82 and the A—azimuth, that are complete linear and angular positioning information. Thus, the tool 10 orientation (positioning) system works in a Polar Coordinates System illustrated by FIG. 15A.

In addition to the information about the radius R and azimuth A, the information about the relative (distance from the earth surface 38) or absolute (distance from the level of the ocean) depth, marked by Z, of the each gauging also comes to the computer 205. This information comes from any device, based, as a rule, on the control of the length of a rope, reeling out from a rig 62 tower drum, on which the tool 10 is suspended in a hole 12. The sum all incoming data (R, A and Z) is used to generate the 3D image of the stope 82 (FIG. 15B) on the computer screen 205 or a system printer when necessary.

The periodic (systematic) processing/development of up-coming data allows a user to conduct operative control of the BHM processes. So, the formula $\pi R^{2*}$ $(Z_2 - Z_1)$ determines the volume of the cavern. The formula $([\pi R_2^{2*} Z_2]-[\pi R_1^{2*} Z_1])/T$, determines the current productivity of borehole mining, where: $Z_2$ and $Z_1$—the lowest and upper elevations of the cavern; $R_1$—the radius of the cavern at the current time $T_1$l; $R_2$—the radius at the current time $T_2$; T—the difference in time between $T_2$ and $T_1$, $\pi$=3.14. This current information may be displayed on the screen 207, too (FIG. 15B).

The preferred embodiment of the nozzle 90 will include a radar system including transmitter 310 and a receiver 312 or the same in one miniature block as, for example, a finger ring transmitter/receiver [2]. Power is delivered to the radar through connectors 314 (FIG. 13) attached to a wiring 218 which connects them to the electronic enclosure 209 which is held within the instrument compartment 184. Thus, to detect the distance from the nozzle 90 and a rock face 308, the transmitter 310 sends a direct signal 313 which bounces off or is reflected off of the face 308. The reflected signal 315 is detected by the receiver 312 which in turn delivers this signal to the system circuitry which accepts and processes it to create data relating to the instant radius of the cavern 82 and cutting orientation.

In an alternate embodiment, an ultrasonic transmitter and receiver will replace the radar transmitter 310 and the receiver 312. The image of the stope or borehole will be developed by use of the ultrasonic sound waves, instead of EM waves. The data will be transmitted to the surface as described above for the radar embodiment.

Following are several samples of other embodiments of the instant invention illustrating its versatility:

1—a miniature radar block 309 can be installed coaxial to the nozzle 90 in front of its entering 101 (see FIG. 14A). This embodiment will improve reflected signal (s) 315 receiving process. It will happened because only straight from the rock face 308 signals 315 will come inside to the nozzle 90 and reach the radar 309.

2—a hydro-turbine 302 may be installed in the water supply channel 144 to recharge the battery 186 (FIG. 14A). It will allow for an increase in the tool's 10 running time without recharging of the battery 186.

Figure 18:
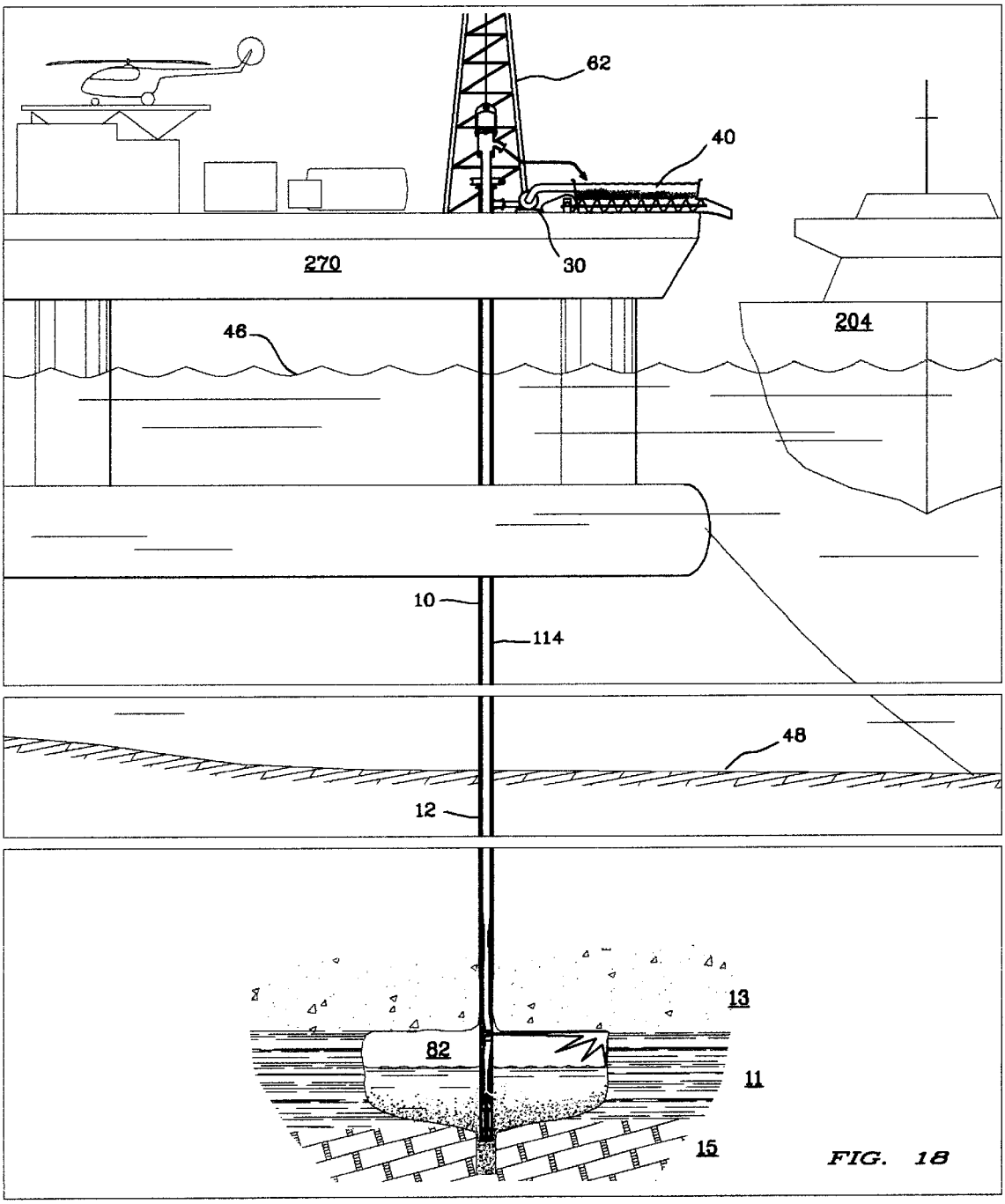
FIG. 18 illustrates an embodiment of the invention applying from the water surface.

3—tool 10 may be used to develop offshore zone from sea/ocean platforms (FIG. 18). It will increase this invention application area. As it can be seen from the illustration, the casing 114 must be extended through the whole depth of the reservoir. Mined material is loaded to any type of vessel 204. Because the drill rig 62 and personal are now on a platform 270, floating on the water surface 46, there is no more a danger of subsidence while borehole mining.

Offered invention also can be used from existing underground mines or open pit's floor.

Thus, it can be appreciated that the above described embodiments of the invention are illustrative of just a few of the numerous variations of arrangements of the disclosed elements used to carry out the patenting idea. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

The offered borehole mining tool is a universal instrument: by shifting of units and parts of its bottom head the tool receives a new quality demonstrating new features and allowing effective use in various geological and hydrogeological conditions and mining of different types of mineral resources (including industrial minerals) as well as applying it in other types of industries, such as environment, building (construction), exploration and others. This tool has following advantages:

wider area of application, simplified serviceability, increased reliability and productivity, improved hydrodynamic characteristics of water and slurry channels, decreased fluids pressure loss, increased water-jet cutting radius, provides a possibility of control of the driving space (cavern).

Except the bottom head, all tool's details, units and parts (pumps, compressors, drilling equipment, pipes, fixtures, gauges and so on)—are standard, using oil and gas drilling industry standard pipes, threads and fittings. This allows for a decrease in the cost of tool manufacturing and operation. It also allows for the attachment of the tool to the customer's existing equipment.

All mentioned advantages guarantee wide application of this device in the mining industry, as well as in-situ leaching, oil/gas/water production stimulation, construction of subterranean storages, building of foundations, underground barriers and collectors, cleaning of tanks, radioactive contamination, nuclear missile shafts and lake bottoms and many other applications. All above mentioned actions can be executed by this tool from ground surface, water surface and underground mines.

Although the present invention has been described with reference to preferred or specific embodiments, numerous modifications and variations can be made and still remain within the scope of the invention. No limitation with respect to the specific embodiments disclosed herein is intended or should be inferred.

We claim:

1. A borehole mining tool comprising a top head protruding from a borehole, a bottom head, and an intermediate section;

said tool consisting of at least two mainly coaxial pipe strings, one of which is an outer pipe column and the second is an inner pipe column, said pipe strings thereby describing:

an inner channel, located inside the inner pipe column and an annulus gap channel, described by the annulus between the outer pipe and the inner pipe, said two coaxial pipe strings thereby describing a dual pipe column having dual pipe column sections, allowing extension of said tool to the required depth of a borehole, said bottom head comprising a hydromonitor section and an eductor section; said hydromonitor section having a hydromonitor with a nozzle hydraulically communicating with said annulus and said tool exterior, such that a stream of fluid from said annulus is ejected from said nozzle at substantially a right angle to a centerline of said tool to said exterior;

said eductor section comprising an eductor nozzle, venturi pipe with an inlet, called confuser and an outlet, called diffuser and a slurry intake port hydraulically communicating with said exterior, wherein the eductor nozzle is either a ring-type nozzle or central-type nozzle, such that said eductor nozzle hydraulically communicates with said gap channel, said venturi pipe hydraulically communicating with said eductor nozzle and said slurry intake port by said confuser, and also said venturi pipe communicating with said tool inner pipe column by said diffuser, said venturi receiving a fluid flow from said eductor nozzle creating a vacuum, whereby a fluid external to said tool is drawn into said venturi and further to said inner column; and said eductor nozzle is connected to said venturi by a dual pipe connector.

2. The mining tool as in claim 1, wherein:

said intermediate section and said bottom head are suspended from said top head by said outer column;

said eductor section is connected to said hydromonitor section by a dual pipe connector; and said hydromonitor section is connected to said dual pipe intermediate section by a dual pipe connector; and finally dual pipe sections are connected to each other by dual pipe connectors.

3. The mining tool as in claim 2, wherein said dual pipe connector further comprises:

an inner first member having a diameter smaller than an outer second member, said first member removeably engaging said inner pipe, said inner pipe having a flexible seal which mates with said inner first member, thereby forming a seal between said inner first member and said inner pipe, and said dual pipe connector further comprising an outer second member which threadably connects with a corresponding outer pipe; and said dual pipe connector being situated on an end of a dual pipe column section, whereby a series of sections may be connected together.

4. The mining tool as in claim 3 wherein said dual pipe connector is compatible with a plurality of devices;

said devices selected from the group of a drill bit, a radar, a sonar, an electric circuit, an antenna, a battery, a sensor, a telescopic sucker, and a generator;

each of said selected devices connected to said tool by a dual pipe connector.

5. The mining tool as in claim 2 further comprising:

a third pipe coaxially inserted into said inner pipe through said top head a predetermined distance, said third pipe having a diameter less than a diameter of said inner pipe.

6. The mining tool as in claim 2, wherein said tool further comprises cleaning elements for cleaning the inside of a well casing.

7. The mining tool as in claim 2 wherein said tool further comprises a drill bit.

8. The mining tool as in claim 2 wherein said hydromonitor further comprises:

a knee plate having a length, said knee plate situated in said annulus, said knee plate connected to an outer surface of said inner pipe and to an inner surface of said outer pipe at a position opposite from said nozzle whereby a thrust from said nozzle is opposed; and said knee plate aligned with a fluid flow.

9. The mining tool as in claim 2 further comprising:

a radar or sonar unit for transmitting and receiving signals such that a radar or sonar image of a borehole and/or a stope is obtained;

an electric circuit having an antenna, whereby a radar or sonar image is transmitted by said antenna to a remote receiver; and said electric circuit receiving power from an energy source.

10. The mining tool as in claim 9 further comprising:

a sensor attached to a lower end of a tool, said sensor sensing an orientation of said tool in relation to the earth's magnetic field;

said antenna transmitting a signal from said sensor to said remote receiver; and said sensor receiving power from said energy source.

11. The mining tool as in claim 10, wherein said energy source further comprises:

a battery connected to a generator, said battery being recharged by said generator being driven by a hydroturbine driven by a fluid flow.

12. A universal tool for land, subsurface and offshore borehole mining, consisting of pipe-in-pipe, generally concentric strings, including at least inner and outer pipe columns, defining an internal channel and an external annulus gap channel allowing high pressure working fluid to be pumped through the one of these and deliver back to the surface a production slurry through another one, having a top head with a swivel, an intermediate section and a bottom head suspended on said intermediate section by an interchangeable hub with a packer, and a drill bit at the tool bottom end, such that said bottom head comprises:

(a) hydromonitor section, including (1) a hydromonitor with an outlet and a barrel having conical shape and an interchangeable nozzle, which cross the inner pipe defining a slurry-passage fork, (2) a knee, secured on the inner pipe, offsetting said fork towards the hydromonitor outlet, and (3) a stabilizing plate which is secured symmetrically to said hydromonitor inlet in said annulus gap, parallel to the tool main axis, (b) an eductor section, including an eductor, having:

(1) an interchangeable nozzle, embodied with possibility of installation inside of it of a replaceable needle to be coaxial to said nozzle and defining an annulus between said needle and said interchangeable nozzle, (2) at least one water-pass duct and at least one slurry intake port, (3) an interchangeable venturi pipe, secured at the bottom end of the inner pipe column, and (4) a universal joint-connector located at an intake of the venturi pipe, and (c) a distribution reservoir, located between said eductor nozzle and said drill bit, whereby said universal connector together with interchangeable hub, hydromonitor nozzle, eductor's interchangeable insertion and eductor's nozzle, allows the tool to accept various of special replaceable means, modifying the tool to execute different types of geo-technical tasks.

13. A tool as claimed in claim 12, wherein all said interchangeable parts have reinforced working surfaces or are armored by a wear-resistant material.

14. A tool as claimed in claim 12, wherein said packer is rotatable, and said tool further comprises cleaning elements for cleaning the inside of a well casing.

15. A tool as claimed in claim 12, wherein between said venturi pipe and intake port a dual stub-pipe is mounted hydraulically connecting said annulus channel to an annulus defined by the venturi's inlet, called confuser, and the needle, said needle is embodied in a shape of a duct with an inner channel, connecting said confuser to the tool exterior, and the bottom end of the annulus between inner and outer columns of the tool is sealed by a plug, which bottom face is armored by rock breaking elements.

16. A tool as claimed in claim 15, wherein said plug is supplied by a telescopic sucker.

17. A tool as claimed in claim 12, wherein said internal pipe is supplied by a secondary agent duct connected by its upper end to a secondary agent source.

18. A tool as claimed in claim 17, wherein said secondary agent duct is connected by its upper end to a high pressure air source and on its bottom end has an aerator, located within the intermediate section.

19. Tool as claimed in claim 17, wherein said secondary agent duct is movable along the tool main axis and the swivel is supplied with a gland seal for sealing said duct, allowing movement of the tool up and down and rotation while mining.

20. A tool as claimed in claim 12, wherein said hub is embodied in a shape of a truncated cone and has inside at least one slurry-pass stub pipe, the cone hydraulically connects the inner pipe of the intermediate section to the annulus gap of the bottom head, and the slurry-pass stub pipe connects the inner pipe of the bottom head to the gap of the intermediate section by at least one window in said cone.

21. A tool as claimed in claim 12, wherein said bottom head is supplied by replaceable protection screen covering the slurry intake port and calibrating taking-in slurry chunks.

22. A tool as claimed in any one of claims 12 or 17, wherein the hub has a secondary agent duct pass channel connecting said duct to tool's exterior by a hole located on said outer pipe below the packer.

23. A tool as claimed in claim 12, further comprising a logging-positioning system which comprises an individual power supply source, an orientation system, an impulse generator, a radar or sonar system for continuously monitoring the cavity while borehole mining and measuring the volume of the cavity to determine the productivity of mining mounted parallel to the hydromonitor and a radio-transmitter with an antenna and on the surface there is a signal receiving—developing station including radio receiver, signal decoder and computer.

24. A tool as claimed in claim 23, wherein said orientation system includes at least one inductor coil which axis is also parallel to the hydromonitor.

* * * * *